US007798634B2

(12) United States Patent
Miyahara et al.

(10) Patent No.: US 7,798,634 B2
(45) Date of Patent: Sep. 21, 2010

(54) RECORDING APPARATUS AND CONTROL METHOD

(75) Inventors: Katsutoshi Miyahara, Kawasaki (JP); Takashi Kawabata, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 593 days.

(21) Appl. No.: 11/467,684

(22) Filed: Aug. 28, 2006

(65) Prior Publication Data

US 2007/0047157 A1 Mar. 1, 2007

(30) Foreign Application Priority Data

Aug. 31, 2005 (JP) ..... 2005-251652
Aug. 2, 2006 (JP) ..... 2006-211054

(51) Int. Cl.
*B41J 2/01* (2006.01)
*B41J 3/407* (2006.01)

(52) U.S. Cl. ..... 347/106; 347/101; 347/105

(58) Field of Classification Search ..... 250/559.16, 250/559.4; 347/14, 16, 19, 101, 105; 356/28
See application file for complete search history.

(56) References Cited

U.S. PATENT DOCUMENTS 5,736,996 A * 4/1998 Takada et al. ..... 347/19
5,764,251 A * 6/1998 Hashimoto ..... 347/16
2005/0088469 A1* 4/2005 Igarashi ..... 347/14
2005/0088710 A1* 4/2005 Nakayama ..... 358/518
2005/0100385 A1* 5/2005 Sato ..... 400/708
2005/0156980 A1* 7/2005 Walker ..... 347/19

FOREIGN PATENT DOCUMENTS

JP 05-087526 A 4/1993
JP 05-346626 A 12/1993

* cited by examiner

*Primary Examiner*—Matthew Luu
*Assistant Examiner*—Kendrick X Liu
(74) *Attorney, Agent, or Firm*—Canon U.S.A., Inc., IP Division

(57) ABSTRACT

At least one exemplary embodiment is directed to a recording apparatus, which includes a sensor having a plurality of light-emitting elements and a plurality of light-receiving elements. The sensor can be configured to perform a detection operation. The detection operation includes at least two of an operation for detecting an edge of a recording medium, an operation for detecting a distance between a recording head and the recording medium, an operation for detecting the density of an image formed on the recording medium, and an operation for detecting the kind of the recording medium.

8 Claims, 12 Drawing Sheets

RECORDING APPARATUS AND CONTROL METHOD

BACKGROUND OF THE INVENTION

1. Field of the Invention

The present invention relates to recording apparatuses that are configured to execute a plurality of detecting operations for a recording operation using an optical sensor and control methods.

2. Description of the Related Art

Conventional inkjet recording apparatuses (hereafter simply called recording apparatuses) generally include various detection or measurement sensors for various purposes in order to improve the image quality, accuracy, user friendliness, etc. For example, a sensor configured to detect the width (size) of a recording sheet (also referred to as a recording medium) set in the recording apparatus or the position of an edge of the recording sheet, a sensor configured to measure the density of a patch (pattern) or an image recorded on the recording sheet, etc., are provided. In addition, a sensor configured to detect the thickness or the presence/absence of the recording sheet, a sensor for determining the kind of the recording sheet, etc., are provided.

The edge detection of the recording sheet is useful for accurate printing in a print area of the recording sheet. In particular, high-accuracy detection is useful in marginless printing. A typical sensor configured to detect an edge of a recording sheet includes a single light-emitting element and a single light-receiving element that form a reflective optical system, and the edge can be detected on the basis of a change in a reflection intensity.

Optical sensors are often installed in recording apparatuses. A typical optical sensor includes a light-emitting element for emitting light and a light-receiving element for receiving the light emitted from the light-emitting element, and outputs an output value corresponding to the amount (intensity) of light received by the light-receiving element. As examples of optical sensors, transmissive and reflective sensors are often used.

The reflective sensors can be configured for detecting the thickness of a recording sheet. In an example of a reflective sensor, a light-emitting element and a light-receiving element can be arranged such that light is emitted from the light-emitting element toward the surface of the recording sheet, which is a detection object, is reflected by the recording sheet, and is received by the light-receiving element. The distance from the reflective sensor to the surface of the recording sheet can be determined on the basis of the amount of light received by the light-receiving element or the position of light received by the light-receiving element. When, for example, an optical reflective sensor is disposed on a carriage, the recording sheet, which is a detection object, is fed from a recording sheet holder and is placed on a platen. The distance between the reflective sensor disposed on the carriage and the platen is already known from the design of the recording apparatus. Therefore, the thickness of the recording sheet can be detected if the distance between the reflective sensor and the surface of the recording sheet can be determined.

Japanese Patent Laid-Open No. 05-087526 discusses a structure in which an LED or a semiconductor laser can be used as the light-emitting element in a sensor configured to detect the thickness of a recording sheet. In this structure, a position sensitive detector (PSD) or a CCD can be used as the light-receiving element. According to this publication, light emitted by the light-emitting element is reflected by a measurement object, and a part of the reflected light is received by the light-receiving element. In this structure, when the distance between the optical sensor and the measurement object varies, the center position of the reflected light received by the light-receiving element varies accordingly. When the light-receiving element is a CCD, the amount of light can be measured for each pixel. Therefore, the center position of the reflected light can be determined by detecting the pixel at which the amount of light has a peak, and the distance between the optical sensor and the measurement object can be calculated by triangulation. In addition, when the light-receiving element is the PSD, the center position of the reflected light received by the light-receiving element can be calculated from two outputs that vary in accordance with the center position of the reflected light, and the distance between the sensor and measurement object can be calculated from the center position by triangulation.

On the other hand, an example of a sensor configured to detect the width or an edge (leading or trailing edge) of a recording sheet includes a single light-emitting element and a single light-receiving element that form a reflective optical system, and the edge can be detected on the basis of a change in a reflection intensity (amount of reflected light). The intensity of light received by the light-receiving element differs between the case in which light emitted from the light-emitting element is reflected by the surface of the recording sheet and the case in which the light emitted from the light-emitting element reflected by members for example a platen or a conveying path that are different from the recording sheet. Therefore, it can be determined whether or not the recording sheet is placed in a detection area of the optical sensor in accordance with the intensity of the reflected light. In an inkjet recording apparatus, a carriage is moved in a direction different from the direction in which the recording sheet is conveyed. Therefore, the longitudinal edges, which are different from the leading and trailing edges, of the recording sheet can also be detected by placing the reflective sensor on the carriage.

As examples of sensors configured to measure a color density of a patch printed on a recording sheet, a sensor including three light-emitting elements for red, blue, and green and a single light-receiving element and a sensor including a white light source and a light-receiving element having a color filter are known. Japanese Patent Laid-Open No. 05-346626 discusses a method for obtaining the color density using such a sensor, in which light is incident on the color patch, reflected by the color patch, and received by the light-receiving element. According to this method, the color density is obtained by calculating an amount of reduction in the reflection intensity with respect to a reference reflection intensity. In an inkjet recording apparatus, a carriage is moved in a direction that intersects the direction in which the recording sheet is conveyed. Accordingly, by placing the reflective sensor on the carriage, the density of the patch recorded at any position on the recording sheet can be detected.

Although there are conventional optical sensors that can individually perform respective detecting operations, structures for performing the respective detecting operations largely differ from each other. Therefore, it has been difficult to perform various detecting operations using an integrated sensor unit. In conventional structures, even when, for example, an integrated sensor unit that can perform various detecting operations is obtained, the size of the sensor unit is increased since each of the sensors included therein has a complex optical system. Therefore, the size of a recording apparatus that includes the sensor unit is also increased.

SUMMARY OF THE INVENTION

At least one exemplary embodiment is directed to an optical sensor used in a detecting operation, such as a distance between a recording head and recording medium, an edge of the recording medium, and a color density.

At least one exemplary embodiment is directed to a recording apparatus that is configured to execute a plurality of detecting operations for a recording operation using an optical sensor and control methods.

At least one exemplary embodiment of the present invention is directed to a recording apparatus that forms an image on a recording medium using a recording head and that includes a first irradiating unit configured to emit light toward a detection surface including a surface of the recording medium such that specular reflected light is obtained; a second irradiating unit configured to emit light toward the detection surface such that diffuse reflected light is obtained; a light-receiving unit including a plurality of light-receiving elements, each light-receiving element detecting an amount of the specular reflected light or the diffuse reflected light; a selecting device configured to select the irradiating unit from which light is to be emitted; and a detecting device configured to perform the detecting operation based on the amount of the reflected light when light is emitted from the irradiating unit selected by the selecting device.

In addition, at least one exemplary embodiment of the present invention is directed to a recording apparatus that forms an image on a recording medium using a recording head and that includes a first irradiating unit configured to emit visible light toward a detection surface including a surface of the recording medium; a second irradiating unit configured to emit light with a wavelength shorter than a wavelength of the visible light toward the detection surface; a light-receiving unit including a plurality of light-receiving elements, each light-receiving element detecting an amount of the reflected light obtained when light is emitted from the first irradiating unit or the second irradiating unit; a selecting device configured to select the irradiating unit from which light is to be emitted; and a detecting device configured to perform the detecting operation based on the amount of the reflected light when light is emitted from the irradiating unit selected by the selecting device.

In addition, at least one exemplary embodiment of the present invention is directed to a recording apparatus that forms an image on a recording medium using a recording head and that includes a irradiating unit including a plurality of the light-emitting elements, each light-emitting element emitting light of different wavelength toward a detection surface including a surface of the recording medium; a light-receiving unit including a plurality of light-receiving elements, each light-receiving element detecting an amount of the reflected light obtained when light is emitted from the irradiating unit; a selecting device configured to select the light-emitting element from which light is to be emitted; and a detecting device configured to perform the detecting operation based on the amount of the reflected light when light is emitted from the light-emitting element selected by the selecting device.

In addition, at least one exemplary embodiment of the present invention is directed to a control method for a recording apparatus that forms an image on a recording medium using a recording head and that includes a first irradiating unit configured to emit light toward a detection surface including a surface of the recording medium such that specular reflected light is obtained; a second irradiating unit configured to emit light toward the detection surface such that diffuse reflected light is obtained; and a light-receiving unit including a plurality of light-receiving elements, each light-receiving element detecting an amount of the specular reflected light or the diffuse reflected light. The control method includes a selecting step of selecting the irradiating unit from which light is to be emitted in accordance with the performed detecting operation of plurality detecting operations for record; and a detecting step of performing the detecting operation based on the amount of the reflected light when light is emitted from the irradiating unit selected by the selecting step.

In addition, at least one exemplary embodiment of the present invention is directed to a control method for a recording apparatus that forms an image on a recording medium using a recording head and that includes a first irradiating unit configured to emit visible light toward a detection surface including a surface of the recording medium; a second irradiating unit configured to emit light with a wavelength shorter than a wavelength of the visible light toward the detection surface; and a light-receiving unit including a plurality of light-receiving elements, each light-receiving element detecting an amount of the reflected light obtained when light is emitted from the first irradiating unit or the second irradiating unit. The control method includes a selecting step of selecting the irradiating unit from which light is to be emitted; and a detecting step of performing the detecting operation based on the amount of the reflected light when light is emitted from the irradiating unit selected by the selecting step.

In addition, at least one exemplary embodiment of the present invention is directed to a control method for a recording apparatus that forms an image on a recording medium using a recording head and that includes a irradiating unit including a plurality of the light-emitting elements, each light-emitting element emitting light of different wavelength toward a detection surface including a surface of the recording medium; and a light-receiving unit including a plurality of light-receiving elements, each light-receiving element detecting an amount of the reflected light obtained when light is emitted from the irradiating unit or the second irradiating unit. The control method includes a selecting step of selecting the light-emitting element from which light is to be emitted; and a detecting step of performing the detecting operation based on the amount of the reflected light when light is emitted from the light-emitting element selected by the selecting step.

According to at least one exemplary embodiment of the present invention, the recording apparatus includes an optical sensor configured to perform detecting operations for obtaining parameters regarding a recording operation (e.g., detection of an edge of a recording sheet, measurement of a reflection density of a color patch, measurement of a distance between the sensor and the surface of the recording sheet, and determination of the kind of the recording sheet).

Further features of the present invention will become apparent from the following description of exemplary embodiments with reference to the attached drawings.

DESCRIPTION OF THE EMBODIMENTS

Figure 1:
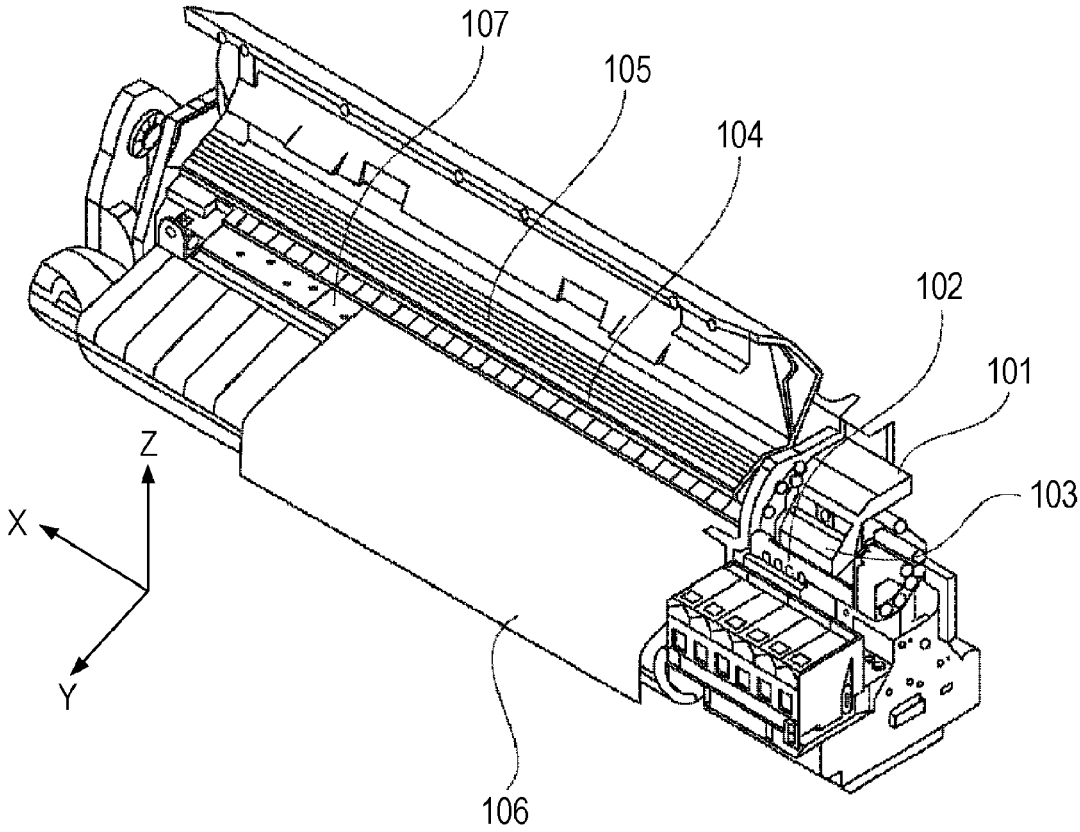
FIG. 1 is a diagram illustrating a section around a carriage in an inkjet printer.

Exemplary embodiments of the present invention will be described in detail below with reference to the accompanying drawings.

The following description of at least one exemplary embodiment is merely illustrative in nature and is in no way intended to limit the invention, its application, or uses.

In the following descriptions, the term "recording sheet" (also referred to as "recording medium" or simply "medium") is not limited to sheets of paper used in common recording apparatuses, but also includes plastic films, metal plates, glass, leather, etc., that are capable of receiving ink. The following description of at least one exemplary embodiment is merely illustrative in nature and is in no way intended to limit the invention, its application, or uses.

Processes, techniques, apparatus, and materials as known by one of ordinary skill in the relevant art may not be discussed in detail but are intended to be part of the enabling description where appropriate, for example the fabrication of sensor elements and their materials.

In all of the examples illustrated and discussed herein any specific values, for example values for the reference position and the reference position, should be interpreted to be illustrative only and non limiting. Thus, other examples of the exemplary embodiments could have different values.

Notice that similar reference numerals and letters refer to similar items in the following figures, and thus once an item is defined in one figure, it may not be discussed for following figures.

As an exemplary embodiment of the present invention, a structure in which an optical sensor can be used in an inkjet recording apparatus and will be described below.

In the present exemplary embodiment, a sensor that detects not only a thickness of a recording sheet but also an edge of a recording medium, a recording density, the kind of a recording medium, and other recording medium characteristics as known by one of ordinary skill, can be used. When many characteristics are detected, expensive elements can be used to increase the detection accuracy, in this situation the cost of the sensor unit may be increased. As a result, the cost of the recording apparatus is also increased.

Description of Inkjet Recording Apparatus (FIG. 1)

FIG. 1 is a schematic perspective view showing the structure of an inkjet recording apparatus.

As shown in FIG. 1, a multi-purpose sensor (optical sensor) 102 configured for various detecting operations and a recording head 103 are mounted on a carriage 101. The carriage 101 is reciprocated on a shaft 105 in a main-scanning direction by a conveying belt 104. The scanning direction of the carriage 101 is defined as X direction. A recording medium, such as a recording sheet 106, is conveyed on a platen 107 by a conveying roller (now shown). The direction in which the recording sheet 106 is conveyed is defined as Y direction. In addition, the direction perpendicular to an XY plane obtained by the X direction and the Y direction is defined as Z direction.

In a recording operation, ink droplets are ejected from the recording head 103 while the carriage 101 is moved in the X direction over the recording sheet 106 that is conveyed to the platen 107 by the conveying roller. After the carriage 101 is moved to an end of the recording sheet 106, the conveying roller conveys the recording sheet 106 by a predetermined distance so that an area to be printed on next is positioned on the platen 107. An image is formed on the recording sheet 106 by repeating the above-mentioned process.

The multi-purpose sensor 102 can detect the width of the recording sheet 106 by detecting the edges of the recording sheet 106 in the X direction. In addition, the multi-purpose sensor 102 can detect the leading and trailing edges of the recording sheet 106 by detecting the edges of the recording sheet 106 in the Y direction. In addition, the multi-purpose sensor 102 can detect the thickness of the recording sheet 106 (sheet thickness) by detecting the distance between the multi-purpose sensor 102 and the surface of the recording sheet 106. In addition, the multi-purpose sensor 102 can determine the kind of the recording sheet 106 by detecting the surface conditions (e.g., flatness, glossiness) of the recording sheet 106. In addition, the multi-purpose sensor 102 can detect the recording density of a recorded patch (pattern) so that recording position adjustment and color calibration for calibrating the recording color can be performed on the basis of the detected recording density. Thus, in the present exemplary embodiment, an example of a "multi-purpose sensor" is an optical sensor capable of performing various detecting operations. In the present exemplary embodiment, the multi-purpose sensor 102 is disposed on a side of the carriage 101 that reciprocates. In addition, the multi-purpose sensor 102 is positioned such that a measurement area thereof is on the upstream of a recording position of the recording head 103 in the Y direction and the bottom surface of the multi-purpose sensor 102 is at the same height or above the bottom surface of the recording head 103. When the multi-purpose sensor 102 is placed at such a position, the width of the recording medium can be detected before the recording operation and the recording operation can be performed without conveying the recording medium in the reverse direction.

Figure 2A:
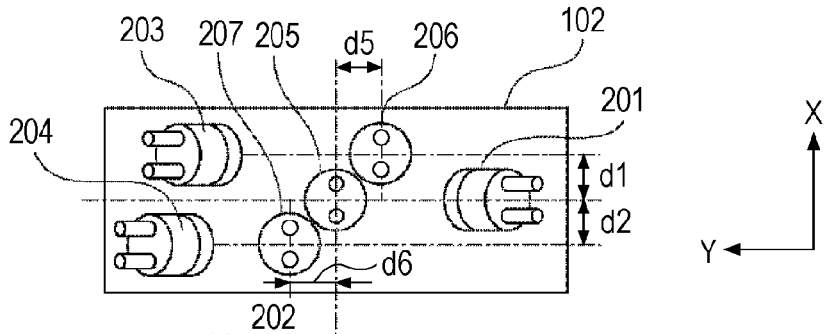
FIGS. 2A and 2B are a plan view and a side view, respectively, illustrating the structure of a multi-purpose sensor.
Figure 2B:
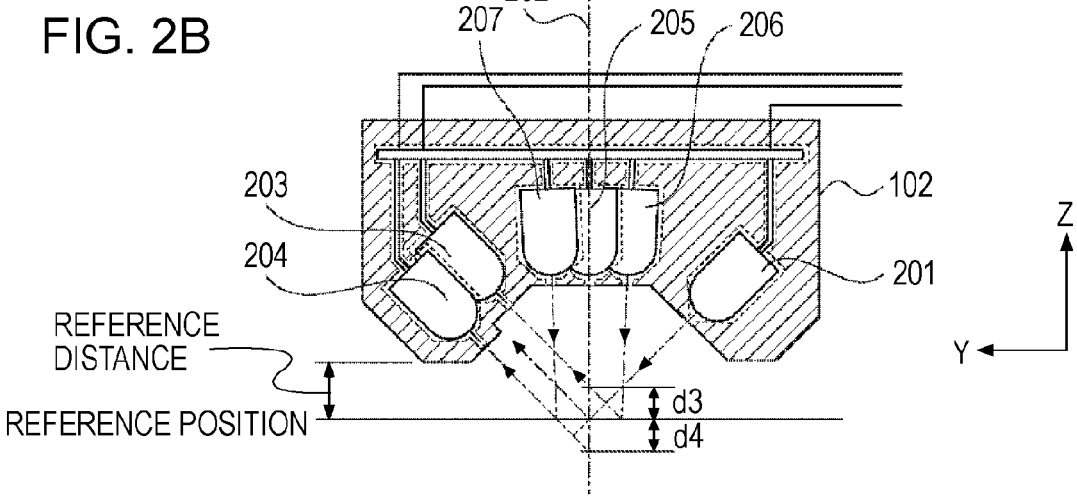

FIGS. 2A and 2B are a plan view and a side view, respectively, of the structure of the multi-purpose sensor 102.

The multi-purpose sensor 102 includes two phototransistors, three visible LEDs, and a single infrared LED as optical elements, where each optical element is driven based on a signal from an external circuit (not shown). For example these elements can be bullet-type elements (mass-produced type with a size of $\phi 3.0$ to $\phi 3.1$) having a diameter of about 4 mm. The visible LEDs and the infrared LED are light-emitting elements (also called light-emitting units and irradiating units), and the phototransistors (photodiodes) can be light-receiving elements (also called light-receiving units).

The infrared LED 201 can have an emission angle of about 45° with respect to a surface (measurement surface) of the recording sheet 106 that is parallel to the XY plane, and is positioned such that the center of the emitted light (i.e., an light axis of the emitted light; hereafter called an irradiation axis) intersects a central axis 202 of the sensor 102 at a predetermined position, the central axis 202 being parallel to the normal (Z axis) of the measurement surface. The intersecting position (intersecting point) of the irradiation axis and the Z axis is defined as a reference position, and the distance between the sensor and the reference position is defined as a reference distance. The width of the emitted light from the infrared LED 201 is adjusted at an opening such that an irradiated surface (irradiated area) with a diameter of about 4 mm to 5 mm is formed on the measurement surface at the reference position. In the present exemplary embodiment, a straight line that passes through the center point of an irradiated area in which light emitted from each light-emitting element is incident on the measurement surface and the center of the light-emitting element is called a light axis (irradiation axis) of the light-emitting element. The irradiation axis is also a centerline of the emitted light.

The phototransistors 203 and 204 have sensitivity to light in a wavelength range that covers visible light and infrared light. The phototransistors 203 and 204 can be arranged such that light-receiving axes thereof are parallel to a reflection axis of the infrared LED 201 when the measurement surface is at the reference position. The light-receiving axis of the phototransistor 203 is placed at a position shifted from the reflection axis by d1 (e.g., +2 mm) in the X direction and d3 (e.g., +2 mm) in the Z direction. The light-receiving axis of the phototransistor 204 is placed at a position shifted from the reflection axis by d2 (e.g., −2 mm) in the X direction and d3 (e.g., 2 mm) in the Z direction. When the measurement surface is at the reference position, light emitted from the infrared LED 201 is reflected at a reflection angle of about 45°. Light that is reflected at the same angle as the emission angle is called specular reflected light. As shown in FIG. 2B, the light axis of the specular reflected light (reflection axis) does not coincide with either of the light axes of light that can be received by the light-receiving elements 203 and 204. Therefore, neither of the light-receiving elements 203 and 204 directly receives the specular reflected light. However, since the light-receiving elements 203 and 204 can be arranged such that the light-receiving axes thereof are parallel to the light axis of the specular reflected light when the measurement surface is at the reference position, the light-receiving elements 203 and 204 can receive reflected light close to the specular reflected light. In the present exemplary embodiment, a straight light that passes through the center point of the area (range) in which light that can be received by each light-receiving element is reflected and the center of the light-receiving element is called a light axis (light-receiving axis) of the light-receiving element. The light-receiving axis is also a centerline of light reflected by the measurement surface and received by the corresponding light-receiving element.

In the measurable range of the multi-purpose sensor according to the present exemplary embodiment, the center of the irradiated area in which light emitted from the infrared LED 201 is incident on the measurement surface (light axis of the infrared LED 201) does not coincide with (intersect) the center of the light-receiving area in which light that can be received by the phototransistor 203 is reflected by the measurement surface (light axis of the phototransistor 203). Similarly, the light axis of the infrared LED 201 does not intersect the light axis of the phototransistor 204. In addition, in the multi-purpose sensor, the two light-receiving elements are shifted from each other in a direction in which the specular reflected light is shifted when the measurement surface is moved.

When the measurement surface is at the reference position, the irradiation axis of the infrared LED 201 and an irradiation axis of a visible LED 205 intersect the measurement surface at the same point. In this state, the light-receiving areas of the phototransistors 203 and 204 are disposed such that the intersecting point is positioned therebetween. A spacer (e.g., with a thickness of about 1 mm) is interposed between the two elements so as to prevent light received by each element from reaching the other element. The phototransistors have openings for limiting light that can be received, and the size of the openings is optimized such that only the light reflected in the area with a diameter of 3 mm to 4 mm can be received when the measurement surface is at the reference position.

Referring to FIGS. 2A and 2B, the visible LED 205 is a single-color visible LED having an emission wavelength corresponding to green (about 510 nm to 530 nm), and is placed such that the light axis of the visible LED 205 coincides with the central axis 202 of the sensor 102. The light axis of the green LED 205 also does not intersect the light axes of the phototransistors 203 and 204. As shown in FIGS. 2A and 2B, when the measurement surface is at the reference position, the point at the intersection of the irradiation axis of the visible LED 205 with the measurement surface coincides with the point at the intersection of the irradiation axis of the infrared LED 201 with the measurement surface. The light emitted from the green LED 205 and reflected can be received by either of the two phototransistors 203 and 204. When an irradiating unit irradiates light to the measurement surface, the color that can be detected by a phototransistor according to the color of the irradiation light is different from the absorption factor or the relation of reflectivity of the light of the measurement surface (recording image). Because reception by the two phototransistors comes in succession with the absorption spectrum of CMY, which has fewer colors than a red, blue light, green light, the reception is suitable for the detection of the CMY patch. The detection accuracy of a variety of detecting operation can be improved, because the green LED 205 is arranged at the visible LEDs 205 to 207 a center and the light emitted from the green LED 205 and reflected can be received by either of the two phototransistors 203 and 204.

A visible LED 206 can be a single-color visible LED having an emission wavelength corresponding to blue (about 460 nm to 480 nm). As shown in FIG. 2A, the LED 206 is placed at a position shifted by d1 (e.g., +2 mm) in the X direction and d5 (e.g., −2 mm) in the Y direction with respect to the visible LED 205. The LED 206 is positioned such that the irradiation axis thereof and the light-receiving axis of the phototransistor 203 intersect the measurement surface at the same point when the measurement surface is at the reference position.

A visible LED 207 can be a single-color visible LED having an emission wavelength corresponding to red (about 620 nm to 640 nm). As shown in FIG. 2A, the LED 207 is placed at a position shifted by d2 (e.g., −2 mm) in the X direction and d6 (e.g., +2 mm) in the Y direction with respect to the visible LED 205. The LED 207 is positioned such that the irradiation axis thereof and the light-receiving axis of the phototransistor 204 intersect the measurement surface at the same point when the measurement surface is at the reference position.

As shown in FIG. 2B, the reflection angle at which light emitted from the visible LEDs 205 to 207 is reflected by the measurement surface differs from the emission angle. Light that is reflected at an angle different from the emission angle is called diffuse reflected light (scattered reflected light, irregularly reflected light).

Although the elements included in the sensor 102 are bullet-type optical elements according to the present exemplary embodiment, the elements are not limited to those of the bullet type. For example, chip-type LEDs, side-view-type light-receiving elements, etc., can also be used as long as the elements are shaped such that the positional relationship therebetween can be maintained. In addition, lenses for performing optical adjustments may be provided near the openings.

Figure 3:
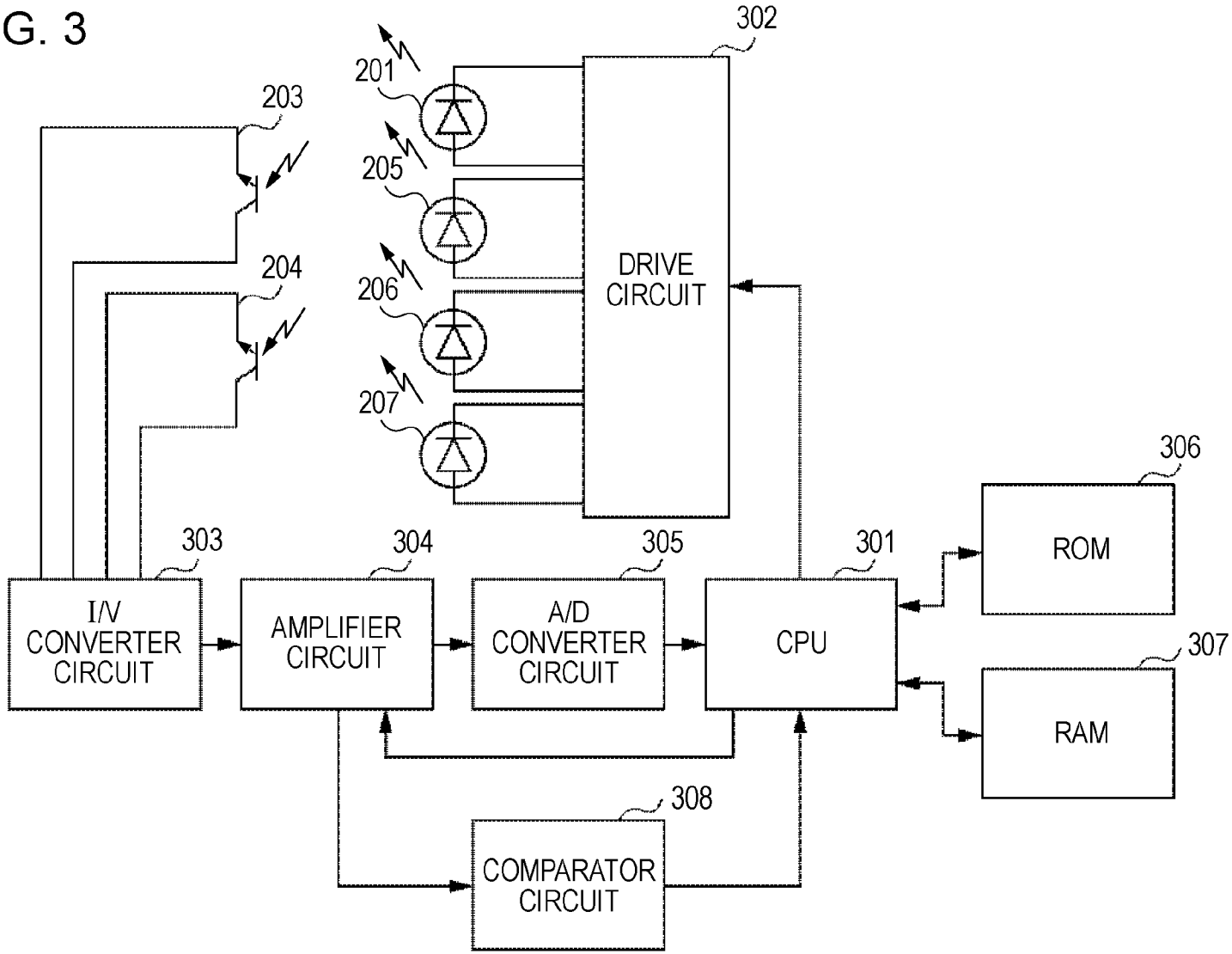
FIG. 3 is a block diagram of an external circuit of the multi-purpose sensor.

FIG. 3 is a block diagram showing the detailed structure of a control circuit for processing input/output signals of the multi-purpose sensor.

A CPU 301 performs ON/OFF control of the infrared LED 201 and the visible LEDs 205 to 207 and sampling of digital outputs from the phototransistors 203 and 204. An LED drive circuit 302 receives an ON signal from the CPU 301 and supplies a constant current to the corresponding LED so as to turn on the LED. An I/V converter circuit 303 converts the output signals transmitted from phototransistors 203 and 204 as current values into voltage values. An amplifier circuit 304 amplifies the output signals converted into voltage values, which are low-level signals, to levels optimum for A/D conversion. An A/D converter circuit 305 converts the output signals amplified by the amplifier circuit 304 into 10-bit digital values and inputs the obtained digital values into the CPU 301. A ROM 306 stores programs for operating the recording apparatus and reference tables for determining desired measurement values from the results of calculation performed by the CPU 301. A RAM 307 can be configured for temporarily storing the sampled outputs of the phototransistors 203 and 204. A comparator circuit 308 compares the outputs from the phototransistors 203 and 204 and transmits an interruption signal to the CPU 301.

Next, methods for acquiring various parameters related to the recording operation using the multi-purpose sensor will be described below.

Method for Detecting Edges of Recording Sheet

Figure 4:
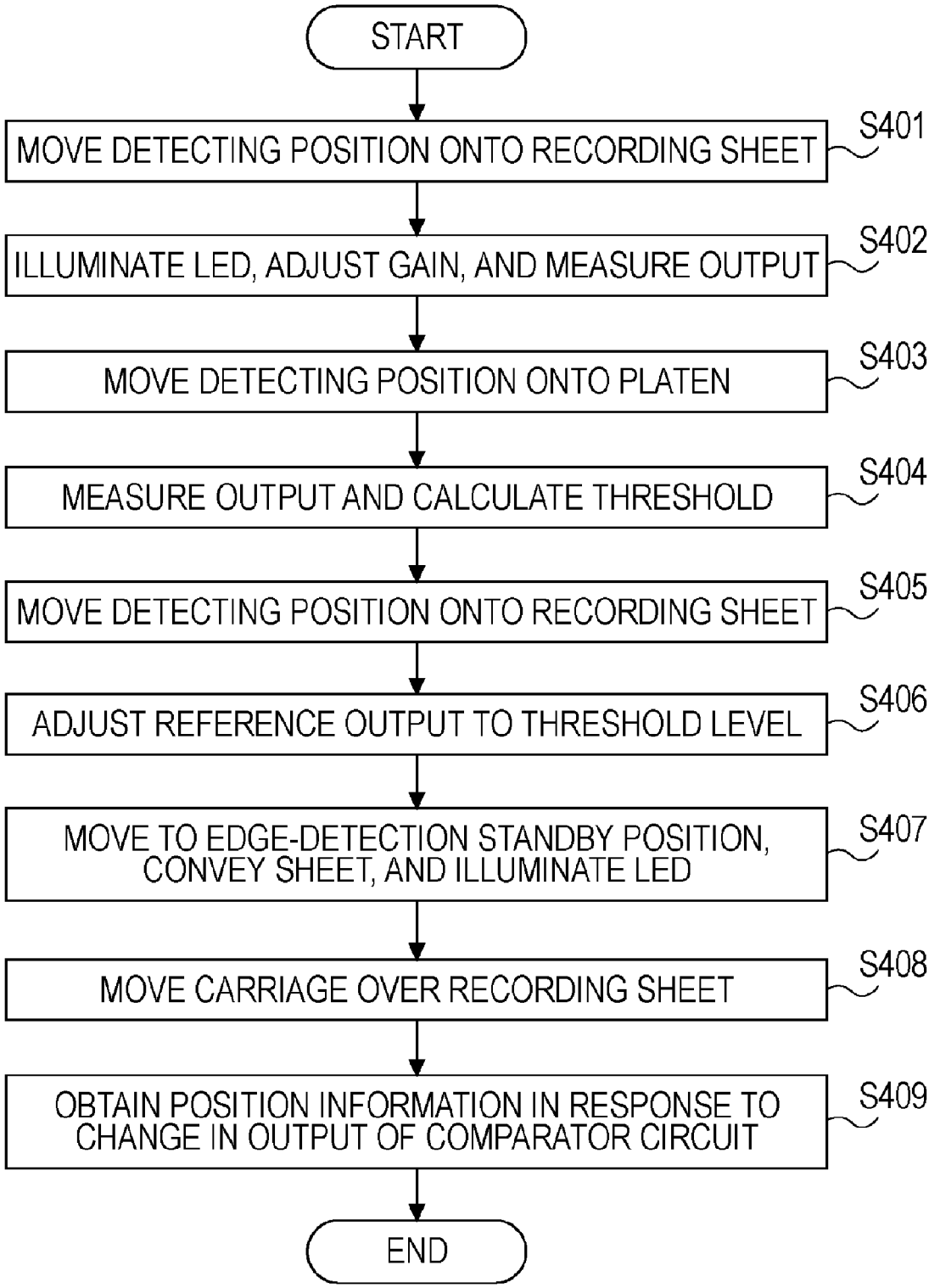
FIG. 4 is a flowchart showing a procedure for detecting an edge position of a recording sheet.

First, a method for detecting the edges of the recording sheet 106 using the above-described sensor 102 will be described. FIG. 4 is a flowchart showing a procedure for detecting an edge position of the recording sheet 106.

The operation for detecting the edge of the recording sheet 106 can be divided into a threshold-determining process (S401 to S406) in which a threshold used for detecting the edge is determined and an output-comparing process (S407 to S409) in which the edge can be detected by comparing the threshold and a detection value of the amount of light reflected by the recording medium or the platen. In the threshold-determining process, a gain adjustment value for optimizing the levels of outputs of the phototransistors 203 and 204 in the sensor 102 for the output-comparing process is determined. In the output-comparing process, the edge of the recording sheet 106 can be detected by comparing the outputs from the two phototransistors 203 and 204. It is not necessary to execute the threshold-determining process each time the edge detection of the recording medium is performed. More specifically, the information of the gain adjustment value obtained by executing the threshold-determining process may be used repeatedly until the conditions of the gain adjustment value are changed. Then, the threshold-determining process can be performed again when the kind of the recording sheet 106 is changed or the recording apparatus is used for a long time, that is, when the amounts of light emitted and received by the optical elements included in the sensor 102 are changed. The detection accuracy can be increased by repeating the threshold-determining process with a short interval. In the following description, the case in which the threshold-determining process and the output-comparing process are successively performed will be explained.

In the threshold-determining process, first, the carriage 101 is moved and the recording sheet 106 is conveyed so that a measurable range (detecting position) of the sensor 102 is positioned on the recording sheet 106 (S401). When the detecting position of the sensor 102 reaches a predetermined position on the recording sheet 106, the carriage 101 and the recording sheet 106 are stopped and the visible LED 205 used for edge detection is turned on (S402). The phototransistors 203 and 204 receive parts of light emitted from the visible LED 205 and reflected by the surface of the recording sheet 106. The CPU 301 adjusts the gain of the amplifier circuit 304 so that the outputs after the A/D conversion (digital outputs) of the output signals from the phototransistors 203 and 204 fall within a predetermined range. In addition, the CPU 301 stores the values of the digital outputs that fall within the predetermined range and the corresponding gain adjustment value in the RAM 307. Here, the digital output values of the phototransistors 203 and 204 that are stored in the RAM 307 are called non-reference outputs, and the gain adjustment value is called a non-reference adjustment value.

After the gain adjustment value for the recording sheet 106 is determined in S402, a gain adjustment value for the platen 107 is determined. First, while the visible LED 205 is turned on, the carriage 101 and the recording medium are relatively moved until the sensor 102 reaches a position where a predetermined position on the platen 107 can be measured (S403). When the detecting position of the sensor 102 reaches the predetermined position on the platen 107, the output values of the phototransistors 203 and 204 are measured using the non-reference adjustment value determined for the recording sheet 106 in S402, and are stored in the RAM 307 (S404). When the non-reference outputs for the recording sheet 106 and the non-reference outputs for the platen 107 are obtained, the CPU 301 calculates a threshold used for the edge detection of the recording sheet 106. When Vm is the non-reference output for the recording sheet 106 and Vp is the non-reference output for the platen 107, the threshold Vth used for detecting the edge of the recording sheet 106 is determined as follows:

$$Vth=Vp+(Vm-Vp)/2$$

The threshold used for detecting the edge of the recording sheet 106 is determined for each of the phototransistors 203 and 204 by the above equation and is stored in the RAM 307.

Then, the carriage 101 and the recording sheet 106 are relatively moved so that the predetermined position on the recording sheet 106 can be measured by the sensor 102 (S405). When the detecting position of the sensor 102 reaches the predetermined position on the recording sheet 106, the CPU 301 adjusts the gain of the amplifier circuit 304 such that the digital output of the phototransistor 203 becomes equal to the threshold for the phototransistor 204 calculated by the above-described process (S406). Then, the CPU 301 stores the thus obtained gain adjustment value in RAM 307. The thus obtained gain adjustment value is called a reference adjustment value. Similarly, the CPU 301 adjusts the gain of the amplifier circuit 304 such that the output from the phototransistor 204 becomes equal to the threshold for the phototransistor 203 calculated by the above-described process, and stores the thus obtained reference adjustment value in the RAM 307. Accordingly, the threshold-determining process is finished.

Figure 5:
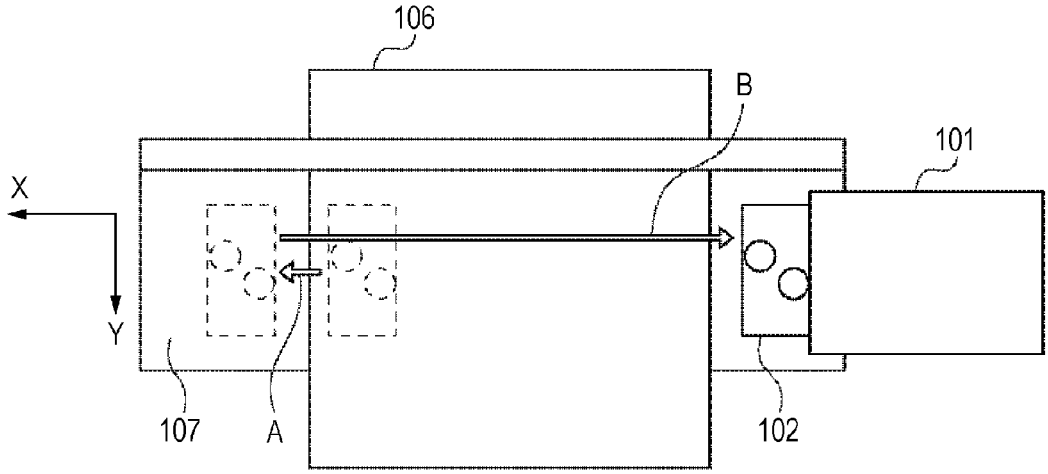
FIG. 5 is a diagram illustrating directions in which the sensor is moved to detect edges of the recording sheet.
Figure 6A:
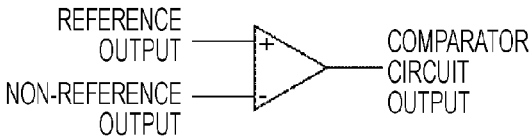
FIGS. 6A and 6B are diagrams illustrating an operation of a comparator circuit.
Figure 6B:
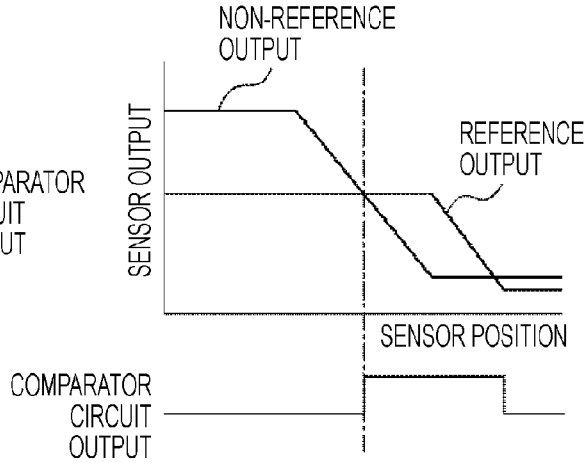

Next, the output-comparing process is performed. FIG. 5 is a schematic diagram illustrating a top view of the recording apparatus. The movement of the sensor 102 in the X direction in an operation of detecting the width of the recording sheet 106 is shown by the arrows (arrows A and B). FIG. 6A illustrates the relationship between the input signals and the output of the comparator circuit. FIG. 6B illustrates the relationship between the outputs from the two phototransistors 203 and 204 and the output from the comparator circuit obtained when the carriage 101 is moved.

First, the carriage 101 is moved and the recording sheet 106 is conveyed so that the detecting position of the sensor 102 is on the recording sheet 106 (S407). When the detecting position of the sensor 102 reaches the predetermined position on the recording sheet 106, the LED 205 is turned on. In addition, the gain of the phototransistor 203 is set to the reference adjustment value and the gain of the phototransistor 204 is set to the non-reference adjustment value. Next, the carriage 101 is moved in the direction shown by the arrow A until the detecting position of the sensor 102 reaches the edge of the recording sheet 106 (the edge adjacent to the phototransistor 204). While the carriage 101 is being moved, the output values from the phototransistors 203 and 204 are sampled at predetermined timing (S408). As the detecting position of the sensor 102 approaches the edge of the recording sheet 106, the output level of the phototransistor 204 starts to fall, as shown in the graph of FIG. 6B. This is because the detecting position, that is, the light-receiving area of the phototransistor 204 on the measurement surface is moved across the edge of the recording sheet 106 into the platen. At this time, the detecting position of the phototransistor 203 is still on the recording sheet 106, and therefore the output from the phototransistor 203 does not change. As the carriage 101 continues to move, the output from the phototransistor 204 is reduced to below the output of the phototransistor 203. Therefore, the output from the comparator circuit 308 is inverted and the position at this time is determined as the edge of the recording sheet 106. Accordingly, the position of the carriage 101 at this time is stored in the RAM 307 (S409). The position of the sensor 102 and the recording sheet 106, when judged that CPU 301 is an edge of the recording sheet 106 in S409, are as follows. The measurable range of the phototransistor 203 is still on the recording sheet 106, and therefore the output from the phototransistor 203 does not change. On the other hand, about the half of the measurable range of the phototransistor 204 is on the recording sheet 106 and remaining the half of the measurable range of the phototransistor 204 is on the platen. Therefore the output from the phototransistor 204 is reduced to below the output of the phototransistor 203.

Next, in order to detect the opposite edge of the recording sheet (the edge adjacent to the phototransistor 203), the gain of the phototransistor 203 is set to the non-reference adjustment value and the gain of the phototransistor 204 is set to the reference adjustment value. In this state, the carriage 101 is moved in the direction shown by the arrow B while sampling the output values from the phototransistors 203 and 204 at predetermined timing. As the detecting position of the sensor 102 approaches the edge of the recording sheet 106, the output level of the phototransistor 203 starts to fall. At this time, the detecting position of the phototransistor 204 is still on the recording sheet 106, and therefore the output from the phototransistor 204 does not change. Then, as the carriage 101 continues to move, the output from the phototransistor 203 is reduced to below the output of the phototransistor 204, and therefore the output from the comparator circuit 308 is inverted. When the output from the comparator circuit 308 is inverted, the position of the carriage 101 at that time is stored in the ROM 307 as the edge position of the recording sheet 106. Thus, the opposite edge of the recording sheet 106 can be detected by executing the output-comparing process of S407 to S409 in the flowchart shown in FIG. 4. Accordingly, the output-comparing process is finished.

Thus, the edge positions of the recording sheet 106 can be determined by the above-described detecting operation. Therefore, the width of the recording sheet 106 in the X direction can be determined from the information obtained by the detecting operation. In addition, when the edge positions of the recording sheet 106 are determined, printing can be accurately started at the edges of the recording sheet 106 and the amount of ink ejected toward the outside of the recording sheet 106 can be reduced in marginless printing. Since the edge positions of the recording sheet 106 can be detected by the sensor 102, ink droplets can be ejected so as not to land on areas that largely protrude outward beyond the edges of the recording sheet 106 by using the relationship between the position of the multi-purpose sensor 102 on the carriage 101 and the landing positions of the ink droplets ejected from the recording head 103 mounted on the carriage 101.

In the present exemplary embodiment, light is emitted from the LED 205 that is disposed parallel to the Z axis and the diffuse reflected light is received by the two phototransistors 203 and 204. However, if the recording sheet is transparent, the level (amount) of diffuse reflected light that can be received is considerably lower than those obtained using other kinds of recording sheets. Therefore, it can be difficult to detect the edge positions of the recording sheet by emitting light from the visible LED 205 as described above. Accordingly, if the recording sheet whose edges are to be detected is transparent, the LED from which light is to be emitted is changed to the infrared LED 201 and the specular reflected light is received by the two phototransistors 203 and 204, so that the edges of the recording sheet can be detected by a similar measurement procedure. If the smoothness of the surface of the recording medium is low, as in the case where the recording medium is normal paper, the intensity of the specular reflected light tends to be low and the intensity of the diffuse reflected light tends to be high. If the smoothness of the surface of the recording medium is high, as in the case where the recording medium is glossy paper, the intensity of the specular reflected light tends to be high and the intensity of the diffuse reflected light tends to be low. Therefore, when the LED from which light is to be emitted is selected depending on the kind of the recording sheet, the edge positions of the recording medium can be more accurately detected. If the kind of the recording sheet is known in advance, the LED from which light is to be emitted for detecting the edges of the recording sheet can be selected depending on the kind of the recording sheet. When the kind of the recording sheet is not known, light can be emitted from the infrared LED 201 and the specular reflected light can be detected if, for example, the amount of diffuse reflected light obtained by emitting light from the visible LED 205 is less than a predetermined value. Alternatively, the amount of reflected light can be detected for each of the visible LED 205 and the infrared LED 201 in advance and the LED to be used may be determined on the basis of the detection result.

Although the edges of the recording sheet 106 in the X direction are detected in the present exemplary embodiment, the edges in the Y direction can also be detected using a similar method.

In addition, although the detecting position of the sensor 102 is moved from the recording sheet 106 to the platen 107 to detect the edges in the present exemplary embodiment, the edges can also be detected by moving the detecting position of the sensor 102 from the platen 107 to the recording sheet 106. In such a case, the output from one of the phototransistors having the detecting position that is completely moved to the recording sheet 106 first can be used as a reference, and the position where the output from the other phototransistor exceeds the reference is determined as the edge.

As described above, by electrically detecting the edges of the recording sheet using the two phototransistors 203 and 204, the load on the CPU can be reduced compared to the conventional method in which the edges of the recording sheet is detected by comparing a digital sensor output sampled by the CPU and a threshold. In addition, the detection speed can be increased when the edges are detected electrically.

Measurement of Reflection Density of Color Patch

Figure 7:
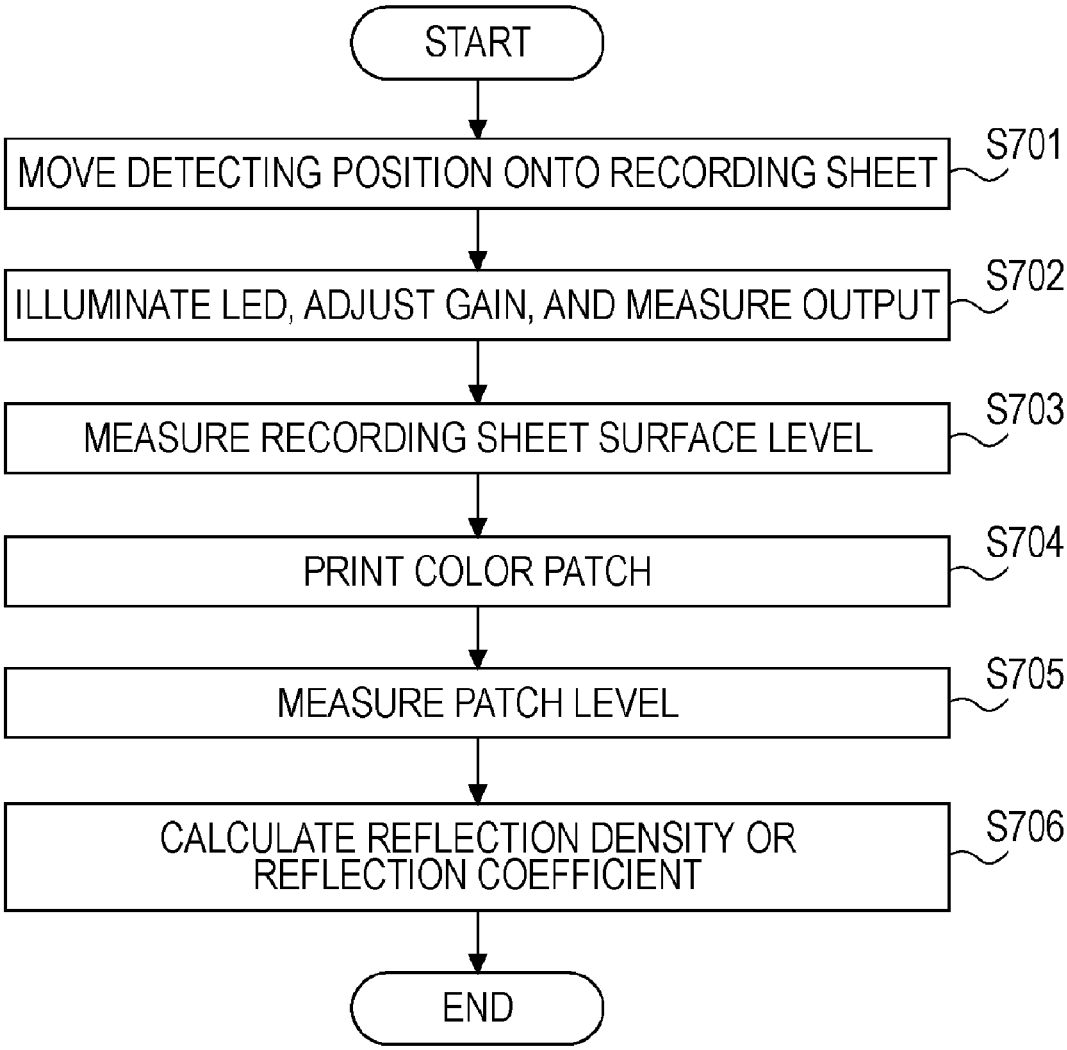
FIG. 7 is a flowchart showing a procedure for detecting a reflection density of a color patch.

Next, a procedure for measuring the reflection density of a color patch printed on the recording sheet 106 using the sensor 102 will be described. As an example, color patches that are separately printed with cyan, yellow, and magenta inks will be considered. FIG. 7 is a flowchart showing a procedure for detecting the reflection density of each color patch.

First, the carriage 101 is moved and the recording sheet 106 is conveyed so that the detecting position of the sensor 102 is positioned on the recording sheet 106 (S701). When the detecting position of the sensor 102 reaches the predetermined position, the LED used for the reflection-density measurement of the color patch is turned on and the gain of the amplifier circuit 304 is adjusted for optimizing the outputs from the phototransistors 203 and 204 (S702). The LED to be turned on differs depending on the color of the measured color patch, and the phototransistor for measuring the reflection level differs depending on the LED that is turned on. The LED used for the measurement can be a visible LED having an emission wavelength corresponding to a complementary color for the color of the measured color patch. The phototransistor to be used for the measurement is determined on the basis of the relationship between the attachment positions of the LEDs and the phototransistors, and one of the phototransistors that can receive a larger amount of light can be configured for the measurement. For example, when the color of the measured color patch is cyan, the LED 207 having an emission wavelength corresponding to red (about 620 nm to 640 nm) is turned on and the reflection level is measured by the phototransistor 204. When the color of the measured color patch is yellow, the LED 260 having an emission wavelength corresponding to blue (about 460 nm to 480 nm) is turned on and the reflection level is measured by the phototransistor 203. When the color of the measured color patch is magenta, the LED 250 having an emission wavelength corresponding to green (about 510 nm to 530 nm) is turned on. In this case, the light emitted from the LED 205 and reflected can be received by either of the two phototransistors 203 and 204. Therefore, one of the phototransistors 203 and 204 having a superior characteristic or both of the phototransistors 203 and 204 can be used. If the color of the measured color patch is known in advance, the LED optimum for the density measurement can be selected from that color. However, if the color of the measured color patch is not known, the LED optimum for the density measurement can be selected on the basis of the outputs obtained from the phototransistors when the LEDs are turned on.

When the red LED 207 is turned on and the optimum gain adjustment value is determined, the reflection level of the recording sheet 106 with respect to light emitted from the red LED 207 is measured (S703). More specifically, first, the carriage 101 is moved and the recording sheet 106 is conveyed such that the detecting position of the phototransistor 204 is moved to a measurement start position on the recording sheet 106. Then, when the detecting position reaches the measurement start position, the red LED 207 is turned on is turned on and the carriage 101 is moved. While the detecting position (light-receiving area) of the phototransistor 204 is being moved from the measurement start position to a predetermined position, the CPU 301 performs control for continuously sampling the digital output value from the phototransistor 204 in synchronization with the carriage position information. When the sampling of the digital output value from the phototransistor 204 in a predetermined area is finished, the CPU 301 calculates the average of the sampled values. The thus obtained average value is determined as the surface reflection level of the recording sheet 106 for the red LED 207. Similarly, surface reflection levels of the recording sheet 106 for the blue LED 206 and the green LED 205 are determined.

After the surface reflection levels of the recording sheet 106 for the red LED 207, the blue LED 206, and the green LED 205 are all measured, color patches whose reflection densities are to be measured are printed on the recording sheet 106 (S704). The size of each color patch can be set such that the printed area thereof is larger than the areas in which light that can be received by the phototransistors 203 and 204 is reflected (light-receiving areas). In such a case, the reflection intensity can be measured with high accuracy. In addition, the optimum size of each color patch in the X direction is determined on the basis of the sampling speed and the sampling number of the CPU 301. For example, patterns with a size of 5×5 mm may be recorded with different amounts of ink, for example, 10%, 50%, and 100%.

After the color patches are printed, the reflection level of each color patch is measured (S705). First, the red LED 207 is turned on to measure the color patch printed with cyan ink, and the gain is set to the gain used in the measurement of the surface reflection level. Then, the carriage 101 is moved and the recording sheet 106 is conveyed such that the detecting position of the phototransistor 204 is moved to a measurement standby position. When the detecting position of the phototransistor 204 reaches the standby position, the carriage 101 is moved. While the detecting position is being moved over the color patch, the digital output of the phototransistor 204 is continuously sampled. When the detecting position of the phototransistor 204 leaves the color patch, the sampling of the output is stopped and the average of the obtained data (digital outputs) is calculated. The thus obtained average value is determined as the reflection level of the color patch, and the reflection density is determined on the basis of the reflection level and the surface level of the recording sheet 106 obtained in the above-described process (S706). When Vw is the surface reflection level of the recording sheet 106 and Vp is the reflection level of the color patch, the reflection density D of the color patch is determined as follows:

$$D=\log10(Vw/Vp)$$

After the reflection density of the color patch is calculated by the above equation, the blue LED 206 is turned on to measure the color patch printed with yellow ink. Then, the reflection densities of the yellow and magenta patches are measured by a method similar to the above-described method for measuring the reflection density of the cyan patch. Similar to the measurement of the surface level of the recording sheet 106, the LED and the phototransistor used for the measurement are changed depending on the color of the measured color patch. More specifically, when the yellow patch is measured, the blue LED 206 is turned on and the reflected light is received by the phototransistor 204. When the magenta patch is measured, the green LED 205 is turned on and the reflected light is received by the phototransistor 203 or the phototransistor 204.

Thus, the reflection densities of the color patches printed on the recording sheet 106 can be measured. The wavelength of light with high absorptance with respect to the color patch differs depending on the color of the color patch. For example, the cyan color patch efficiently absorbs light in the red wavelength, the yellow color patch efficiently absorbs light in the blue wavelength, and the magenta color patch efficiently absorbs light in the green wavelength. Thus, since the three visible LEDs 205, 206, and 207 for the three colors are included in the sensor 102 and used in accordance with the light absorption characteristics of the color patch, the reflection densities of color patches of various colors can be measured with high sensitivity.

In addition, in the sensor 102 according to the present exemplary embodiment, the directions in which light is emitted from the LEDs are substantially parallel to the normal of the recording sheet 106. Accordingly, by switching the phototransistor for receiving light between the two phototransistors 203 and 204, the reflected light can be received at an angle of approximately 45°. Therefore, the LEDs have similar characteristics with respect to the density.

In addition, in the present exemplary embodiment, the densities of the color patches having a predetermined size are measured. However, in the recording apparatus in which the multi-purpose sensor is installed, a density correction can also be performed in the process of producing recording data from image data by measuring the color density of an image printed on the recording medium.

In addition, correction values for reducing the recording-position displacements can be obtained by printing a pattern for adjusting the recording-position displacements of ink droplets ejected from the recording head and measuring the density of the pattern using the sensor 102. The recording-position displacements include recording-position displacements between the heads, recording-position displacements in the reciprocating direction, and the recording position displacements in the conveying direction.

Measurement of Distance between Sensor and Recording Sheet

Figure 12A:
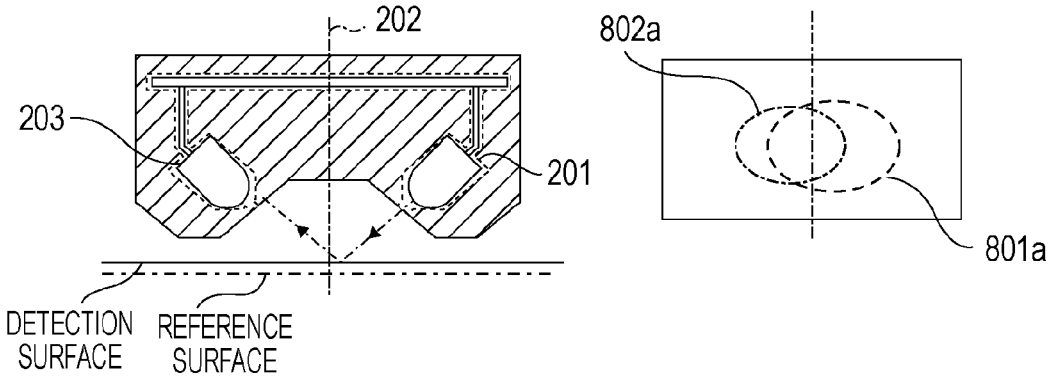
FIGS. 12A, 12B, and 12C are diagrams illustrating the manner in which an irradiated area and a light-receiving area vary in a conventional sensor when a distance between the sensor and a detection surface is varied.
Figure 12B:
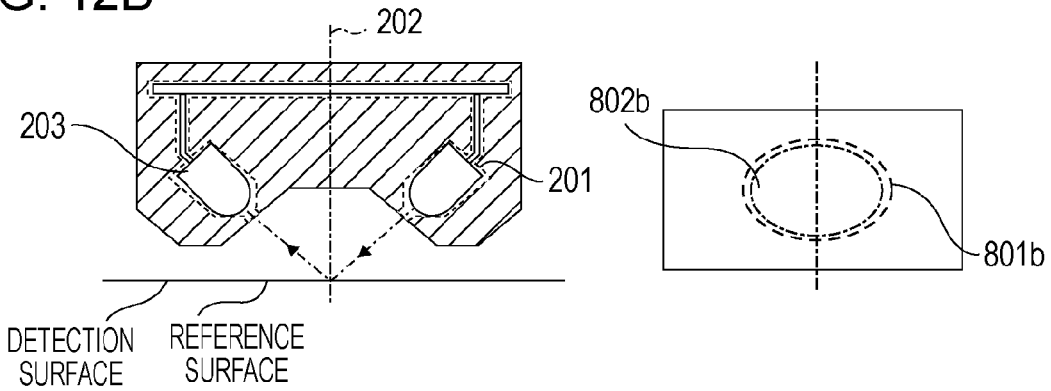
Figure 12C:
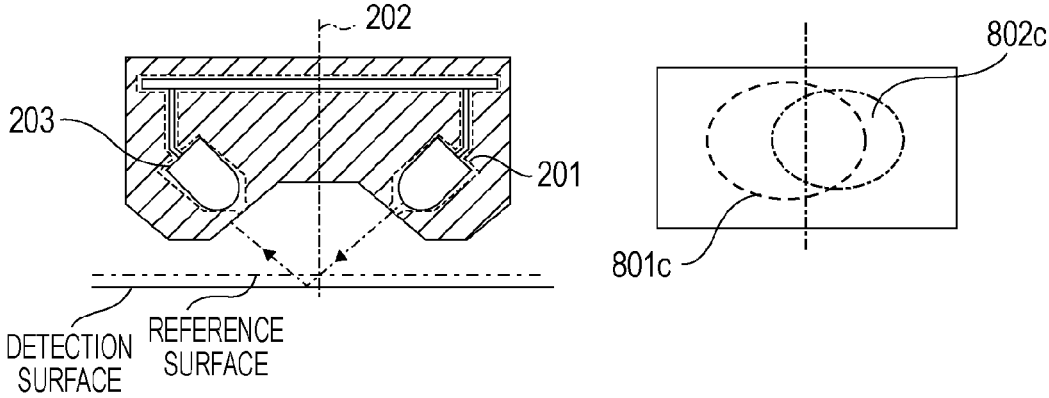
Figure 13:
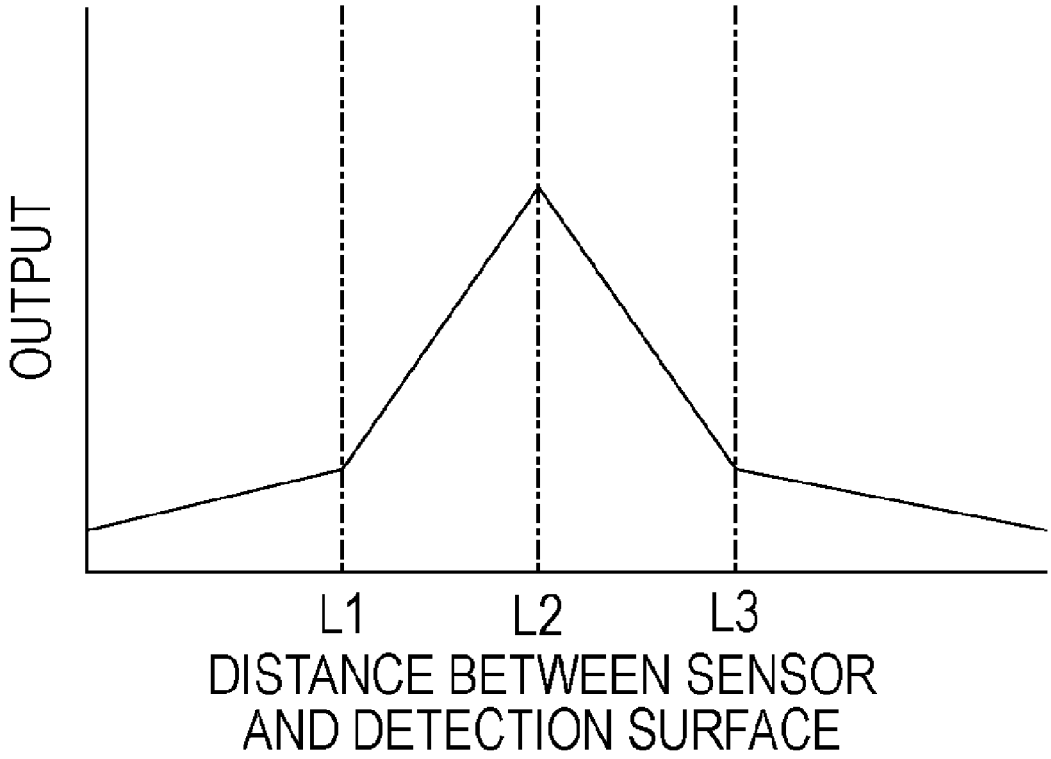
FIG. 13 is a graph showing the output that varies in accordance with the distance between the conventional sensor and the detection surface.

When a light-emitting element (for example an LED) and a light-receiving element (for example a photodiode) are used in an optical sensor configured to detect the thickness of a recording sheet, the cost of the optical sensor is low. However, there is a problem that it cannot be determined whether the detection object is approaching or moving away from a predetermined position. FIG. 12A is a diagram illustrating the state (L1) in which the distance to a detection surface is shorter than that to a reference surface by a distance (e.g., 1 mm). FIG. 12B is a diagram illustrating the state (L2) in which the distance to the detection surface is equal to that to the reference surface. FIG. 12C is a diagram illustrating the state (L3) in which the distance to the detection surface is longer than that to the reference surface by a distance (e.g., 1 mm). In a reflective optical sensor, a light-receiving element 203 is disposed at a position where the amount of light that is emitted from a light-emitting element 201, reflected by the detection surface, and received by the light-receiving element 203 is at a maximum in the state (L2) shown in FIG. 12B. In other words, the optical sensor is arranged such that a light axis of the light reflected by the reference surface coincides with the center of the light-receiving element 203. The distance between the optical sensor and the detection surface in this state is called a reference distance and the detection surface in this state is called the reference surface. As the reference surface, a sheet having a predetermined reflection characteristic that functions as a reference for sensor calibration can be used. As shown in FIG. 12A, when the detection surface is closer to the sensor than the reference surface, that is, when the distance between the detection surface and the sensor is shorter than the reference distance, the amount of light received by the light-receiving element 203 is smaller than the amount of light received by the light-receiving element 203 after being reflected by the reference surface. This is because the light axis of the light reflected by the detection surface does not coincide with the center of the light-receiving element 203. In this state, an irradiated area 801*a* in which the light emitted from the light-emitting element 201 is incident on the detection surface is shifted from a light-receiving area 802*a* of the light-receiving element 203 on the detection surface. Similarly (e.g., 801*c*, 802*c*), as shown in FIG. 12C, when the detection surface is farther from the sensor than the reference surface, the amount of light received by the light-receiving element 203 is reduced. However, the amount of light received (i.e., the intersection of light-receiving areas 801*b*, 802*b*) is a maximum in state L2 (FIG. 12B). FIG. 13 shows a graph of the output from the light-receiving element 203 obtained when the distance between the optical sensor and the detection surface is varied. Thus, when an inexpensive reflective sensor is used, it cannot be determined whether the detection surface is approaching or moving away from the reference surface.

Figure 8:
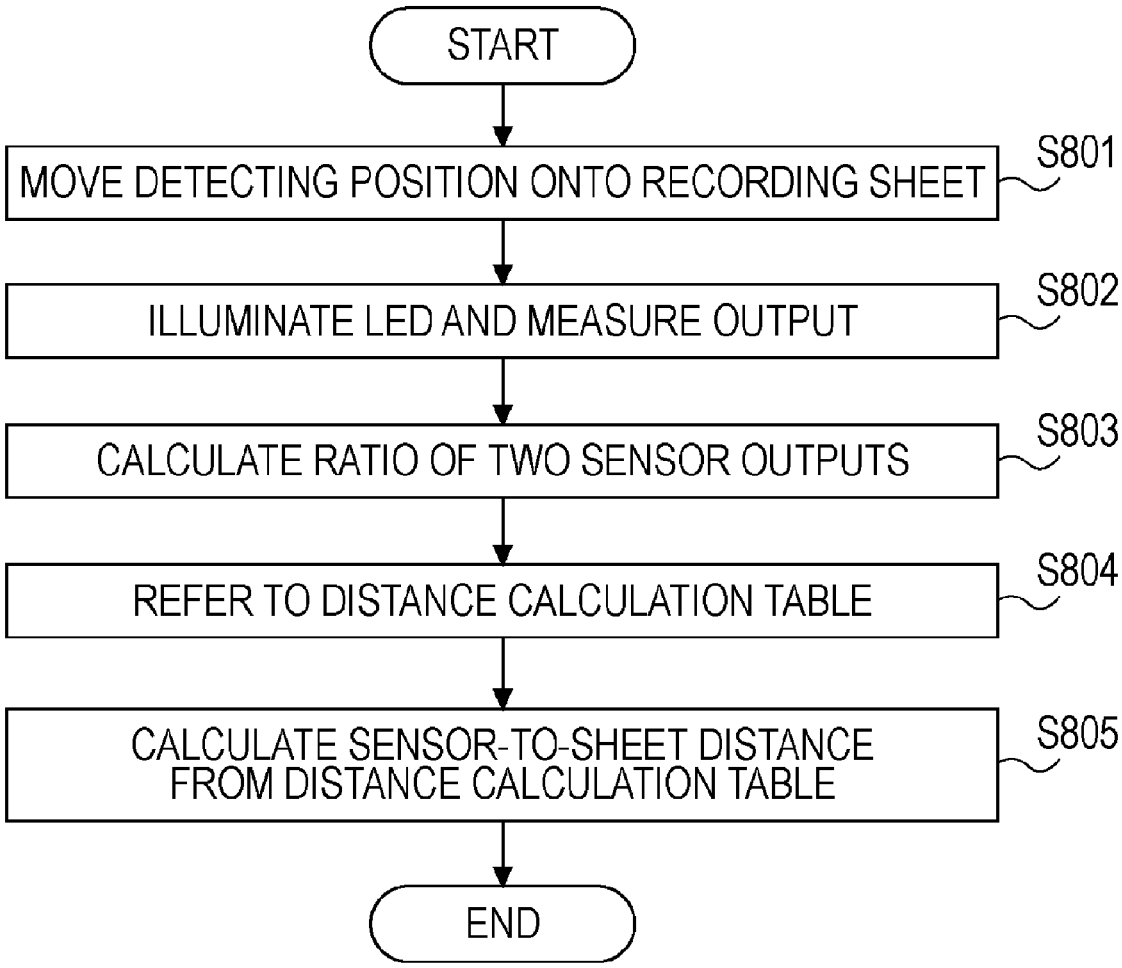
FIG. 8 is a flowchart showing a procedure for detecting a distance.

Next, a method for determining a distance between the sensor 102 and the surface (measurement surface) of the recording sheet 106 according to the present exemplary embodiment will be described below. FIG. 8 is a flowchart showing a procedure for measuring the distance to the recording sheet 106 using the sensor 102.

First, the carriage 101 is moved and the recording sheet 106 is conveyed so that the detecting position of the sensor 102 is positioned on the recording sheet 106 (S801). When the detecting position of the sensor 102 reaches a predetermined position, the LED 201 emits light toward the measurement surface (S802). The light emitted from the LED 201 is reflected by the surface of the recording sheet 106 and the phototransistors 203 and 204 receive parts of the reflected light. The outputs from the phototransistors 203 and 204 vary in accordance with the areas in which the irradiated area of the LED 201 overlaps the light-receiving areas of the phototransistors 203 and 204 and which differ depending on the distance to the measurement surface. The phototransistors 203 and 204 and the LED 201 can be arranged such that the centers of the light-receiving areas of the phototransistors 203 and 204 on the measurement surface do not coincide with the center of the irradiated area. Since the centers of the light-receiving elements and the light-emitting element on the measurement surface do not coincide with each other, compared to the structure in which the centers thereof coincide with each other, the overlapping areas largely vary in response to even a slight variation in the position of the recording sheet 106 that functions as the measurement surface, that is, in the distance between the sensor and the surface of the recording sheet 106. Therefore, the outputs from the phototransistors 203 and 204 largely vary depending on the position of the measurement surface.

Figure 9A:
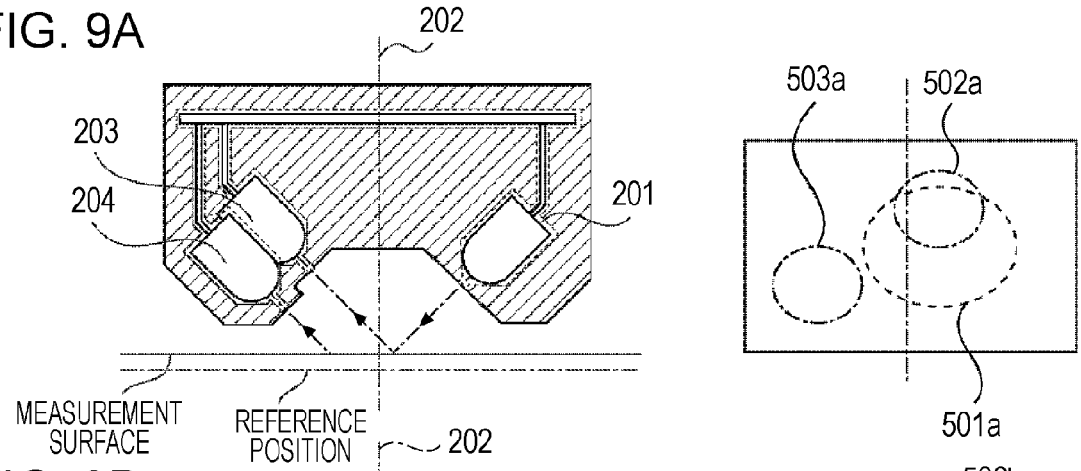
FIGS. 9A, 9B, and 9C are diagrams illustrating the manner in which an irradiated area and light-receiving areas vary depending on a distance between the sensor and a measurement surface.
Figure 9B:
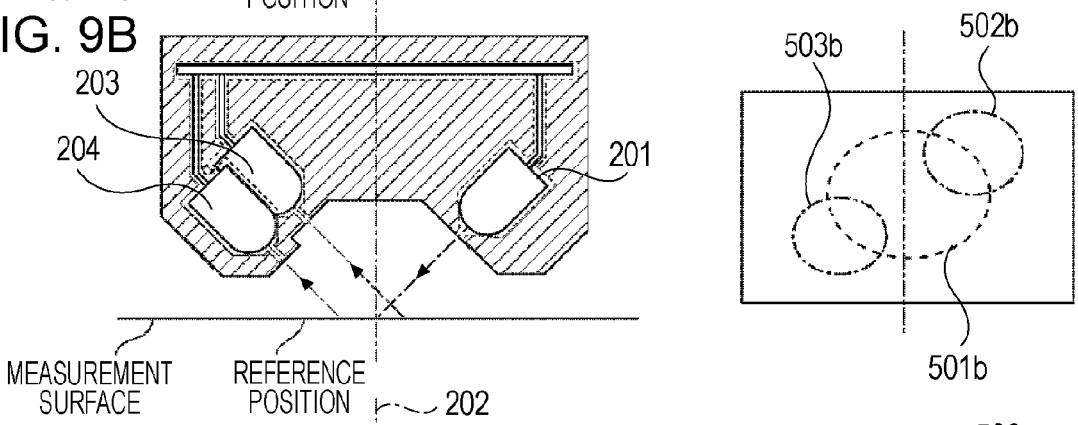
Figure 9C:
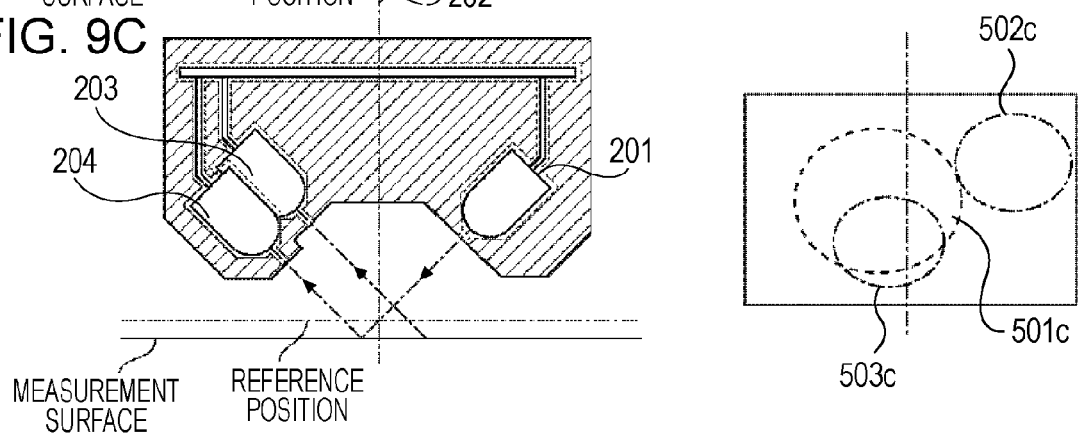

FIGS. 9A, 9B, and 9C are diagrams illustrating the manner in which the irradiated area and the light-receiving areas vary depending on the distance between the sensor 102 and the measurement surface. In FIGS. 9A to 9C, reference numeral 501*a-c* denotes the irradiated area, that is, the area irradiated by the infrared LED 201, 502*a-c* denotes the light-receiving area of the phototransistors 203, and 503*a-c* denotes the light-receiving area of the phototransistor 204.

Figure 10:
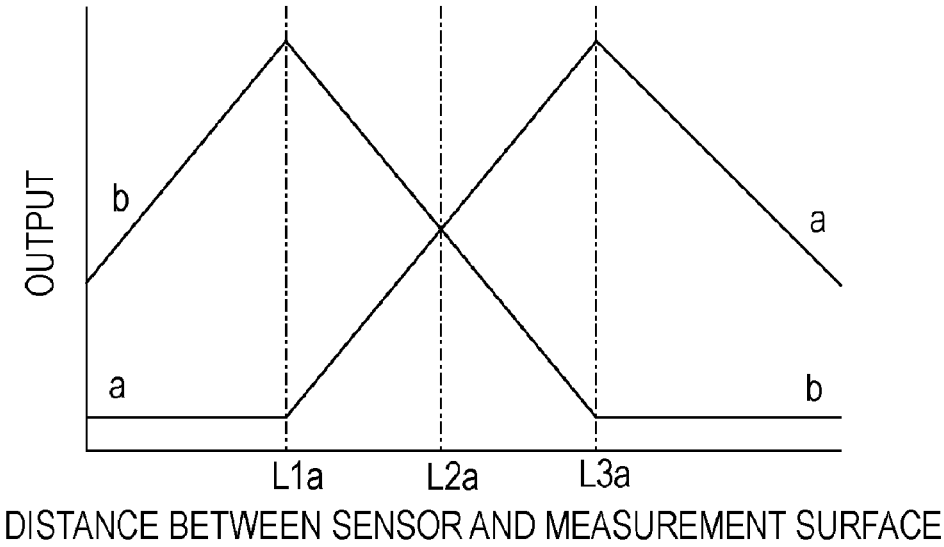
FIG. 10 is a graph showing outputs that vary in accordance with the distance between the sensor and the measurement surface.

FIG. 10 is a graph showing the outputs of the two phototransistors 203 and 204 that vary in accordance with the distance between the sensor 102 and the measurement surface. In FIG. 10, the output from the phototransistor 203 is shown by 'a', and the output from the phototransistor 204 is shown by 'b'.

As is clear from FIGS. 9A to 9C, the centers of the light-receiving areas 502*a-c* and 503*a-c* do not coincide with the center of the irradiated area 501*a-c*. Therefore, compared to the sensor arrangement in which the centers of the light-receiving area and the irradiated area coincide with each other, in the sensor arrangement according to the present exemplary embodiment, the overlapping areas of the light-receiving areas 502*a-c* and 503*a-c* largely vary in response to even a slight variation in the distance between the sensor 102 and the measurement surface.

FIG. 9A (state L1*a*) shows the manner in which the irradiated area 501*a* overlaps the light-receiving areas 502*a* and 503*a* when the distance between the sensor 102 and the measurement surface is shorter than that at the reference position by a distance (e.g., about 1 mm). In this state, a major portion of the light-receiving area 502*a* coincides with the irradiated area 501*a*. Therefore, as shown in FIG. 10, the output from the phototransistor 203 (curve b) has a peak in this state (L1*a*). In comparison, the light-receiving area 503*a* does not overlap the irradiated area 501*a*, and accordingly the output from the phototransistor 204 (curve a) is at a minimum in this state (L1*a*).

FIG. 9B (state L2*a*) shows the manner in which the irradiated area 501*b* overlaps the light-receiving areas 502*b* and 503*b* when the distance between the sensor 102 and the measurement surface is equal to that at the reference position. In this state (L2*a*), the size of the area in which the irradiated area 501*b* overlaps the light-receiving area 502*b* is substantially equal to the area in which the irradiated area 501*b* overlaps the light-receiving area 503*b*. Therefore, the outputs from the phototransistors 203 and 204 are both about one-half of the peaks thereof, as shown in FIG. 10.

FIG. 9C (state L3*a*) shows the manner in which the irradiated area 501*c* overlaps the light-receiving areas 502*c* and 503*c* when the distance between the sensor 102 and the measurement surface is longer than that at the reference position by a distance (e.g., about 1 mm). In this state (L3*a*), a major portion of the light-receiving area 503*c* coincides with the irradiated area 501*c*. Therefore, as shown in FIG. 10, the output from the phototransistor 204 (curve a) has a peak in this state. In comparison, the light-receiving area 502*c* does not overlap the irradiated area 501*c*, and accordingly the output from the phototransistor 203 (curve b) is at a minimum in this state.

As described above, the outputs from the phototransistors 203 and 204 vary in accordance with the distance between the sensor and the measurement surface. The distance between the positions at which the outputs from the phototransistors 203 and 204 have peaks is determined in accordance with the distance between the phototransistors 203 and 204, the inclinations of the phototransistors 203 and 204 with respect to the measurement surface, and the inclination of the infrared LED 201 with respect to the measurement surface. The arrangement is optimized on the basis of the measurement range.

When the outputs from the phototransistors 203 and 204 that vary in accordance with the distance to the recording sheet 106 are obtained, the CPU 301 calculates a distance coefficient L on the basis of the two outputs. When Va is the output from the phototransistor 203 and Vb is the output from the phototransistor 204, the distance coefficient L is calculated as follows:

$$L=(Va-Vb)/(Va+Vb)$$

The distance coefficient L varies in accordance with the distance between the sensor 102 and the measurement surface. When the output from the phototransistor 203 (curve b in FIG. 10) is at a peak (L1*a*), the distance coefficient L is at a minimum. When the output from the phototransistor 204 (curve a in FIG. 10) is at a peak (L3*a*), the distance coefficient L is at a maximum. Considering the characteristics of the distance coefficient L, the measurement range can be set within a range defined by the peaks of the two phototransistors 203 and 204. Accordingly, the measurement range of the sensor 102 according to the present exemplary embodiment is within ±ΔE (e.g., ±1 mm) with respect to the reference position.

The outputs Va and Vb obtained by the two phototransistors 203 and 204 and used in the above equation can be normalized by the respective maximum values. In this case, the peak values can be obtained when the sensor 102 is subjected to initial adjustment or calibration, and be stored in the RAM 307 in advance.

Figure 11:
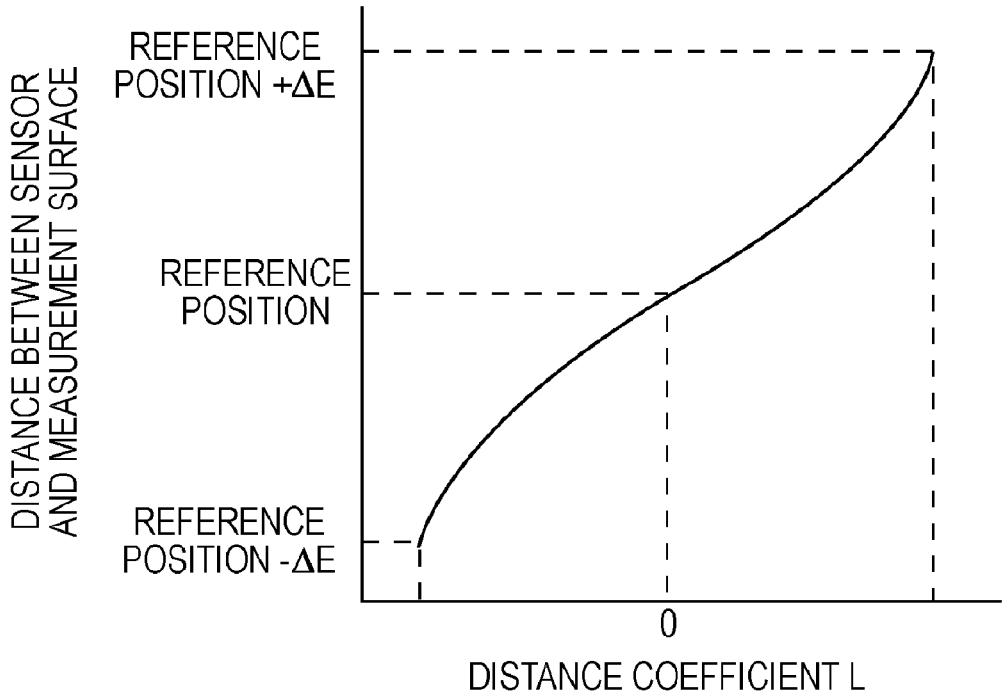
FIG. 11 is a diagram showing a distance reference table.

When the distance coefficient L is determined by calculation performed by the CPU 301, the distance reference table recorded in the ROM 306 is read out (S804). FIG. 11 shows an example of a distance reference table. The distance coefficient L determined by the above equation varies along a slightly curved line with respect to the distance due to the output characteristics of the two phototransistors 203 and 204. The distance reference table is prepared for accurately determining the distance to the measurement object on the basis of the distance coefficient L obtained by calculation. The CPU 301 determines the distance to the measurement object on the basis of the distance coefficient L obtained by calculation and the distance reference table, and outputs the determined distance (S805). When the distance to the measurement surface is determined, the thickness of the recording sheet 106 can also be calculated using the distance to the platen 107. More specifically, the thickness of the recording sheet 106 may be obtained as a difference between the distance to the measurement surface when the platen is the measurement object and the distance to the measurement surface when the recording sheet 106 is the measurement object.

The distance between the sensor 102 and the surface of the recording sheet 106 can be determined by the above-described method. According to at least one exemplary embodiment of the present invention, instead of using PSDs or CCDs, elements for example phototransistors, which are relatively inexpensive, can be used as the light-receiving elements. Therefore, although the distance-measuring function is additionally provided in the recording apparatus, the cost is not largely increased. In addition, the accuracy required in inkjet printers can be achieved.

In addition, since the distance between the multi-purpose sensor 102 and the surface of the recording sheet is determined, it can also be determined whether or not the distance between the recording head and the surface of the recording sheet is adequate. If the distance between the recording head and the surface of the recording sheet is too small, the recording head easily comes into contact with the surface of the recording sheet during the recording operation, thereby damaging the recording sheet. In addition, if the distance between the recording head and the surface of the recording sheet is too large, positions at which ink droplets ejected from the recording head land on the recording medium are easily displaced and the quality of the recorded image is reduced. Accordingly, a structure for adjusting the vertical position of the recording head in accordance with the distance to the surface of the recording sheet can also be provided.

In addition, even when the recording position adjustment is performed in the recording apparatus, the recording position will be displaced if the distance between the recording head and recording sheet changes. Therefore, parameters used in the recording position adjustment can be corrected on the basis of the distance to the recording sheet determined by the multi-purpose sensor 102. Accordingly, high-quality images can always be recorded with accurate recording positions irrespective of the thickness of the recording sheet.

In a conventional distance sensor, two light-receiving elements and the light-emitting element are generally arranged on the same plane. Therefore, because of the characteristics of the diffused light, the detection result is easily affected by the variation in the intensity of light incident on the measurement object and blurring of the irradiated area and the light-receiving areas that occurs when the distance varies. Therefore, in the output curve of each light-receiving element, the inclinations before and after the peak can be asymmetrical to each other. As a result, the accuracy of the distance sensor can be reduced due to positions where the sensitivity is low.

In comparison, according to the multi-purpose sensor of the present exemplary embodiment, the rising portion and the falling portion of the output curve show good symmetry. More specifically, the distance coefficient calculated on the basis of the difference and the sum of the output signals obtained by the two phototransistors becomes close to linear with respect to the distance to the measurement surface. According, high-accuracy distance detection can be performed. In the present exemplary embodiment, the distance detection can be performed with a precision of 0.1 mm to 0.2 mm.

As described above, according to the present exemplary embodiment, a small, inexpensive multi-purpose sensor that can perform the detection of the edges of the recording sheet, the measurement of color density, and the detection of the distance to the measurement surface is obtained. In this sensor, since the light axis of light emitted from the light-emitting element and the light axes of light that can be received by the light-receiving elements can be arranged such that they do not cross one another, the light-receiving elements always output different output values irrespective of the distance between the sensor and the surface of the detection object. As a result, the measurement accuracy of the distance between the optical sensor and the recording sheet is increased. In addition, since the detection is performed on the basis of the output signals obtained from the two light-receiving elements arranged with a gap therebetween in both the conveying direction of the recording medium and the direction of normal of the recording medium, the adverse affects to the detection accuracy in the two output signals can cancel each other and accurate detection can be performed.

The light-emitting element used when the amount of specular reflected light is to be detected and the light-emitting element used when the amount of diffuse reflected light is to be detected are arranged on the central axis of the sensor, and the light-receiving elements are arranged such that the central axis is positioned between the light-receiving elements. Therefore, the size of the sensor can be reduced.

Although the light-emitting elements that emit visible light and infrared light (invisible light) can be used in the present exemplary embodiment, light-emitting elements that emit ultraviolet light as the invisible light can also be used in addition to the light-emitting element that emit invisible light.

Determination of Kind of Recording Medium

Next, a method for determining the kind of a recoding medium using the multi-purpose sensor 102 will be described.

In general, recording sheets have different reflection characteristics depending on the kind thereof. For example, if the smoothness of the surface of a recording sheet is high, as in the case where the recording sheet is glossy paper, the intensity of the specular reflected light tends to be high and the intensity of the diffuse reflected light tends to be low. If the smoothness of the surface of a recording sheet is low, as in the case where the recording sheet is normal paper, the intensity of the diffuse reflected light tends to be high and the intensity of the specular reflected light tends to be low. Accordingly, the kind of the recording sheet can be determined on the basis of the reflection characteristics that differ depending on the state of the surface of the recording sheet. More particularly, the kind of the recording sheet can be determined by storing in the memory a table showing the relationship between the kind of the recording sheet and the amounts of the specular reflected light and the diffuse reflected light that can be received by the light-receiving elements when light is incident on the recording sheet.

Since the reflection characteristics differ in accordance with the kind of the recording medium, the distance coefficient L can also be changed in accordance with the characteristics of the recording sheet when the distance is measured. More specifically, when the distance between the sensor and the surface of the recording sheet is to be determined with high accuracy, instead of preparing only one distance calculation table (FIG. 8), a plurality of tables for different kinds of recording sheets can be prepared and be selectively used in accordance with the kind of the recording sheet. Thus, by selecting the reflected light configured for the detection in accordance with the kind of the recording sheet, the thickness and edges of the recording sheet can be accurately detected for various recording sheets irrespective of the kind thereof.

In the present exemplary embodiment, to allow the distance detection for recording sheets for example clear films, the infrared LED 201 and the phototransistors 203 and 204 can be arranged so as to form the regular reflection angle. However, since the visible LED 205 is also included in the sensor 102, if it is difficult to detect the distance to a recording sheet using the specular reflected light, the visible LED 205 that emits light perpendicular to the recording sheet can be used and the diffuse reflected light can be measured.

As described above, according to the present exemplary embodiment, the recording apparatus includes the multi-purpose sensor that can perform the detecting operations for obtaining the parameters regarding the recording operation (i.e., the edge detection of a recording sheet, the measurement of reflection density of a color patch, the measurement of the distance between the sensor and the surface of the recording sheet, the determination of the kind of the recording medium, etc.)

Figure 14:
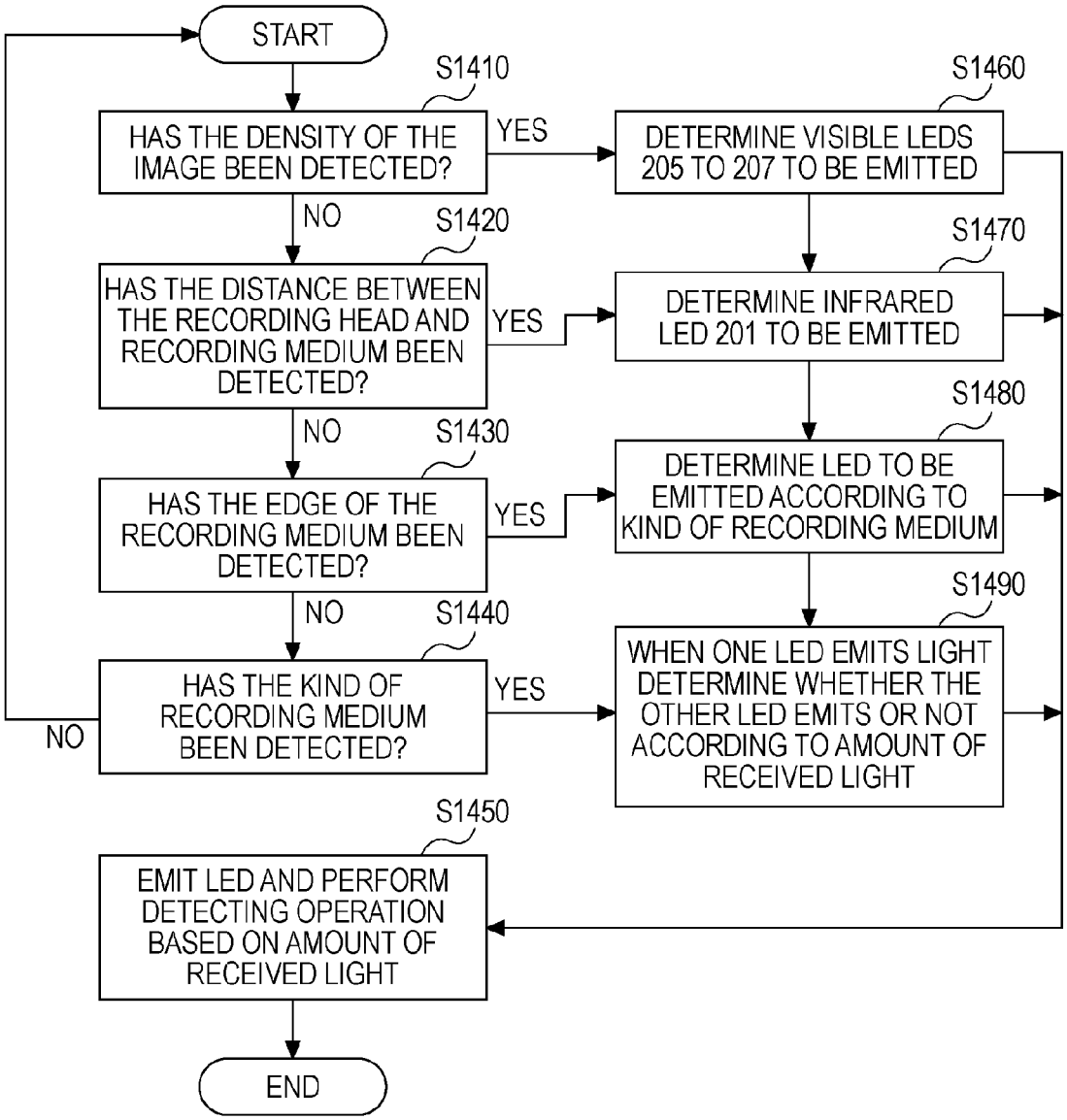
FIG. 14 is a flowchart showing a procedure for selecting irradiating units corresponding to detecting operations.

FIG. 14 shows a flowchart of processing that selects the irradiating units corresponding to detecting operation. As shown in FIG. 14 CPU 301 selects a suitable irradiating unit for doing the executed detecting operation of plurality detecting operations for the record. CPU 301 selects the irradiating unit according to the processing program stored in memory 306 or 307. First a check is made to see if the density of the image has been detected (S1410). If step S1410 is affirmative (Yes) then one determines (step S1460) the visible LEDs to be emitted, then the LEDs emit light and a detection operation is enacted, where the detection is based upon the amount of received light (S1450). If step S1410 is false (No) then one proceeds to step S1420, where one determines whether the distance between the recording head and the recording medium has been detected. If step S1420 is affirmative (Yes) then one determines (step S1470) that the infrared LED is to be emitted, then the infrared LED emit light and a detection operation is enacted, where the detection is based upon the amount of received light (S1450). If step S1420 is false (No) then one proceeds to step S1430, where one determines whether the edge of the recording medium has been detected. If step S1430 is affirmative (Yes) then one determines (step S1480) which LEDs are to be emitted based upon the kind of recording medium, then the LEDs emit light and a detection operation is enacted, where the detection is based upon the amount of received light (S1450). If step S1430 is false (No) then one proceeds to step S1440, where one determines whether the kind of recording medium has been detected. If step S1440 is affirmative (Yes) then one determines (step S1490) whether a second LED emits light when a first LED does, based upon the amount of received light. After step S1490, the LEDs emit light and a detection operation is enacted, where the detection is based upon the amount of received light (S1450). If step S1440 is false (No) then it returns to the start to do processing that selects the irradiating unit.

Accordingly, unlike the conventional structure in which a plurality of kinds of sensor units must be installed, only one sensor can be installed in the recording apparatus. Therefore, the installation space and the cost of the sensor can be reduced. Although the two phototransistors are offset from each other in the multi-purpose sensor so that the distance between the sensor and the recording sheet can be measured, the emission angles of the LEDs are set to optimum angles with respect to the light-receiving areas of the phototransistors. Therefore, the edge detection of the recording sheet and the measurement of the reflection density of the color patch are not affected by the arrangement of the phototransistors. Thus, the processing methods described in the present exemplary embodiment can achieve the accuracy required by the recording apparatus with regard to all of the functions.

In addition, according to the present invention, the specular reflected light or the diffuse reflected light can be selected in accordance with the kind of the recording medium, and the thickness and the edges of the recording medium are detected using the suitable reflected light. In addition, since the detection is performed using the output signals obtained from the two light-receiving elements that are separated from each other in both the conveying direction of the recording medium and the direction toward the recording medium, the adverse affects to the detection accuracy in the two output signals are reduced or cancel each other and the detection accuracy can be increased.

In addition, the present exemplary embodiment, discussed using four detecting operations of the detection of the edges of the recording medium, the measurement of the density of the color patch, the detection of the distance between the sensor and the recording medium, and the determination of the kind of the recording medium. However, exemplary embodiments are not limited to using all of these four detection operations but at least two detection operations. For instance, the exemplary embodiment that executes two detection operations of the detection of the edges of the recording medium and the detection of the distance between the sensor and the recording medium, and the exemplary embodiment that executes three detection operations of the detection of the edges of the recording medium, the detection of the distance between the sensor and the recording medium and the measurement of the density of the color patch are included within the range of exemplary embodiments of this invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-251652 filed Aug. 31, 2005, and Japanese Application No. 2006-211054 filed Aug. 2, 2006, which are hereby incorporated by reference herein in their entirety.

What is claimed is:

1. A recording apparatus that forms an image on a type of recording medium using a recording head, the recording apparatus comprising:

a scanning device configured to reciprocate, in a first direction, a carriage on which the recording head is mounted;

a conveying device configured to convey the recording medium in a second direction different from the first direction;

a first irradiating unit configured to emit light toward a detection surface including a surface of the recording medium such that specular reflected light is obtained;

a second irradiating unit configured to emit light toward the detection surface such that diffuse reflected light is obtained;

a light-receiving unit including a plurality of light-receiving elements, each light-receiving element detecting an amount of the specular reflected light or the diffuse reflected light;

a selecting device configured to select one of the first and second irradiating units from which light is to be emitted; and a detecting device configured to perform a detection operation based on the amount of the reflected light emitted from the irradiating unit selected by the selecting device, wherein the first and the second irradiating units and the light-receiving unit are provided on the carriage, the second irradiating unit including a plurality of light-emitting elements, the plurality of light-emitting elements being arranged in a direction different from both the first direction and the second direction, and the plurality of light-receiving elements being arranged in a direction diagonal to both the first direction and the second direction in the same plane, wherein the detecting operation includes detecting the type of recording medium, and wherein the selecting device selects the irradiating unit from which light is to be emitted in accordance with the type of recording medium detected.

2. The recording apparatus according to claim 1, wherein the detection operation includes a plurality of detecting operations which includes at least two of a detecting operation for detecting an edge of the recording medium, a detecting operation for detecting a distance between the recording head and the recording medium, a detecting operation for detecting a density of an image formed on the recording medium, and a detecting operation for detecting the type of recording medium.

3. The recording apparatus according to claim 1, wherein at least one of the scanning device and the conveying device moves at least one of the carriage and the recording medium in accordance with the detection operation.

4. The recording apparatus according to claim 1, wherein the second irradiating unit emits visible light and the first irradiating unit emits light with a wavelength shorter than a wavelength of the visible light.

5. The recording apparatus according to claim 1, wherein the second irradiating unit emits a plurality of wavelengths in the visible spectrum.

6. The recording apparatus according to claim 2, wherein, when the detecting operation for detecting the edge of the recording medium is performed, the selecting device selects the second irradiating unit as the irradiating unit from which light is to be emitted and the detecting device detects the edge of the recording medium on the basis of the amounts of the diffuse reflected light detected by the light-receiving elements.

7. The recording apparatus according to claim 2, wherein, when the detecting operation for detecting the density of the image is performed, the selecting device selects the second irradiating unit as the irradiating unit from which light is to be emitted and the detecting device detects the density on the basis of the amounts of the diffuse reflected light detected by the light-receiving elements.

8. The recording apparatus according to claim 2, wherein, when the detecting operation for detecting the distance between the recording head and the recording medium is performed, the selecting device selects the first irradiating unit as the irradiating unit from which light is to be emitted and the detecting device detects the distance on the basis of the amounts of the reflected light detected by the light-receiving elements.

* * * * *